US009396706B2

(12) United States Patent
Sung

(10) Patent No.: US 9,396,706 B2
(45) Date of Patent: Jul. 19, 2016

(54) MEMORY, MEMORY ADDRESSING METHOD, AND DISPLAY DEVICE INCLUDING THE MEMORY

(71) Applicant: SAMSUNG DISPLAY CO., LTD., Yongin, Gyeonggi-Do (KR)

(72) Inventor: Si-Duk Sung, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 398 days.

(21) Appl. No.: 13/897,332

(22) Filed: May 17, 2013

(65) Prior Publication Data

US 2014/0002468 A1 Jan. 2, 2014

(30) Foreign Application Priority Data

Jun. 29, 2012 (KR) ..... 10-2012-0070928

(51) Int. Cl.

| | |
|---|---|
| ***G09G 5/399*** | (2006.01) |
| ***G09G 3/32*** | (2006.01) |
| ***G09G 5/14*** | (2006.01) |
| ***G09G 3/00*** | (2006.01) |
| ***G09G 3/20*** | (2006.01) |

(52) U.S. Cl.

CPC ..... *G09G 5/399* (2013.01); *G09G 3/003* (2013.01); *G09G 3/2022* (2013.01); *G09G 3/3208* (2013.01); *G09G 5/14* (2013.01); *G09G 2300/0452* (2013.01); *G09G 2300/0857* (2013.01); *G09G 2310/0224* (2013.01)

(58) Field of Classification Search

None

See application file for complete search history.

(56) References Cited

U.S. PATENT DOCUMENTS

| | | | | |
|---|---|---|---|---|
| 5,416,510 | A * | 5/1995 | Lipton et al. | 348/43 |
| 5,615,046 | A * | 3/1997 | Gilchrist | 359/464 |
| 2003/0222882 | A1 * | 12/2003 | Jeffrey et al. | 345/560 |
| 2007/0008314 | A1 * | 1/2007 | Song et al. | 345/419 |
| 2008/0030435 | A1 * | 2/2008 | Kim | 345/76 |
| 2008/0211976 | A1 * | 9/2008 | Nam et al. | 349/15 |
| 2011/0102447 | A1 * | 5/2011 | Lin | 345/570 |
| 2011/0316892 | A1 * | 12/2011 | Sung et al. | 345/690 |
| 2013/0155049 | A1 * | 6/2013 | Marsan | 345/419 |

FOREIGN PATENT DOCUMENTS

| | | | |
|---|---|---|---|
| JP | 2004-29783 | A | 1/2004 |
| KR | 10-2005-0081386 | A | 8/2005 |
| KR | 10-2007-0005093 | A | 1/2007 |
| KR | 10-2011-0083510 | A | 7/2011 |

* cited by examiner

*Primary Examiner* — Maurice L McDowell, Jr.
*Assistant Examiner* — Donna J Ricks
(74) *Attorney, Agent, or Firm* — Lewis Roca Rothgerber Christie LLP

(57) ABSTRACT

The present invention relates to a memory, a memory addressing method, and a display device. The memory stores first image data and second image data of a line unit stored in a line buffer unit. The memory includes at least a first DDR3 memory and a second DDR3 memory, reads the first image data of the line unit, divides the read first image data of the line unit, and writes the divided data to a corresponding block among a plurality of blocks of each of the first DDR3 memory and the second DDR3 memory. Also, the memory reads second image data of the line unit, divides the read second image data of the line unit, and writes the divided data to another corresponding block among the plurality of blocks of each of the first DDR3 memory and the second DDR3 memory.

31 Claims, 18 Drawing Sheets

FIG.3A

| 1 | AL1_1 | AR1_1 | BL1_1 | BR1_1 |
|---|---|---|---|---|
| 2 | | | | |
| ⋮ | ⋮ | ⋮ | ⋮ | ⋮ |
| 1080 | | | | |

| 1 | AL1_2 | AR1_2 | BL1_2 | BR1_2 |
|---|---|---|---|---|
| 2 | | | | |
| ⋮ | ⋮ | ⋮ | ⋮ | ⋮ |
| 1080 | | | | |

FIG.3B

| | | | | |
|---|---|---|---|---|
| 1 | AL1_1 | AR1_1 | BL1_1 | BR1_1 |
| 2 | AL2_1 | AR2_1 | BL2_1 | BR2_1 |
| ⋮ | ⋮ | ⋮ | ⋮ | ⋮ |
| 1080 | | | | |

| | | | | |
|---|---|---|---|---|
| 1 | AL1_2 | AR1_2 | BL1_2 | BR1_2 |
| 2 | AL2_2 | AR2_2 | BL2_2 | BR2_2 |
| ⋮ | ⋮ | ⋮ | ⋮ | ⋮ |
| 1080 | | | | |

FIG.3C

| | | | | |
|---|---|---|---|---|
| 1 | AL1_1 | AR1_1 | BL1_1 | BR1_1 |
| 2 | AL2_1 | AR2_1 | BL2_1 | BR2_1 |
| ⋮ | ⋮ | ⋮ | ⋮ | ⋮ |
| 1080 | AL1080_1 | AR1080_1 | BL1080_1 | BR1080_1 |

| | | | | |
|---|---|---|---|---|
| 1 | AL1_2 | AR1_2 | BL1_2 | BR1_2 |
| 2 | AL2_2 | AR2_2 | BL2_2 | BR2_2 |
| ⋮ | ⋮ | ⋮ | ⋮ | ⋮ |
| 1080 | AL1080_2 | AR1080_2 | BL1080_2 | BR1080_2 |

FIG.6A

| | | | | |
|---|---|---|---|---|
| 1 | AL1_1 | | BL1_1 | |
| 2 | | | | |
| 3 | | | | |
| ⋮ | ⋮ | | ⋮ | |
| 1080 | | | | |

| | | | | |
|---|---|---|---|---|
| 1 | AL1_2 | | BL1_2 | |
| 2 | | | | |
| 3 | | | | |
| ⋮ | ⋮ | | ⋮ | |
| 1080 | | | | |

| | | | | |
|---|---|---|---|---|
| 1 | AL1_3 | | BL1_3 | |
| 2 | | | | |
| 3 | | | | |
| ⋮ | ⋮ | | ⋮ | |
| 1080 | | | | |

| | | | | |
|---|---|---|---|---|
| 1 | AL1_4 | | BL1_4 | |
| 2 | | | | |
| 3 | | | | |
| ⋮ | ⋮ | | ⋮ | |
| 1080 | | | | |

FIG.6B

| | | | | |
|---|---|---|---|---|
| 1 | AL1_1 | | BL1_1 | |
| 2 | AL2_1 | | BL2_1 | |
| 3 | | | | |
| ⋮ | ⋮ | | ⋮ | |
| 1080 | | | | |

| | | | | |
|---|---|---|---|---|
| 1 | AL1_2 | | BL1_2 | |
| 2 | AL2_2 | | BL2_2 | |
| 3 | | | | |
| ⋮ | ⋮ | | ⋮ | |
| 1080 | | | | |

| | | | | |
|---|---|---|---|---|
| 1 | AL1_3 | | BL1_3 | |
| 2 | AL2_3 | | BL2_3 | |
| 3 | | | | |
| ⋮ | ⋮ | | ⋮ | |
| 1080 | | | | |

| | | | | |
|---|---|---|---|---|
| 1 | AL1_4 | | BL1_4 | |
| 2 | AL2_4 | | BL2_4 | |
| 3 | | | | |
| ⋮ | ⋮ | | ⋮ | |
| 1080 | | | | |

FIG.6C

| | | | | |
|---|---|---|---|---|
| 1 | AL1_1 | | BL1_1 | |
| 2 | AL2_1 | | BL2_1 | |
| 3 | AL3_1 | | BL3_1 | |
| ⋮ | ⋮ | | ⋮ | |
| 1080 | | | | |

| | | | | |
|---|---|---|---|---|
| 1 | AL1_2 | | BL1_2 | |
| 2 | AL2_2 | | BL2_2 | |
| 3 | AL3_2 | | BL3_2 | |
| ⋮ | ⋮ | | ⋮ | |
| 1080 | | | | |

| | | | | |
|---|---|---|---|---|
| 1 | AL1_3 | | BL1_3 | |
| 2 | AL2_3 | | BL2_3 | |
| 3 | AL3_3 | | BL3_3 | |
| ⋮ | ⋮ | | ⋮ | |
| 1080 | | | | |

| | | | | |
|---|---|---|---|---|
| 1 | AL1_4 | | BL1_4 | |
| 2 | AL2_4 | | BL2_4 | |
| 3 | AL3_4 | | BL3_4 | |
| ⋮ | ⋮ | | ⋮ | |
| 1080 | | | | |

FIG.6D

| | | | | |
|---|---|---|---|---|
| 1 | AL1_1 | | BL1_1 | |
| 2 | AL2_1 | | BL2_1 | |
| 3 | AL3_1 | | BL3_1 | |
| ⋮ | ⋮ | | ⋮ | |
| 1080 | AL1080_1 | | BL1080_1 | |

| | | | | |
|---|---|---|---|---|
| 1 | AL1_2 | | BL1_2 | |
| 2 | AL2_2 | | BL2_2 | |
| 3 | AL3_2 | | BL3_2 | |
| ⋮ | ⋮ | | ⋮ | |
| 1080 | AL1080_2 | | BL1080_2 | |

| | | | | |
|---|---|---|---|---|
| 1 | AL1_3 | | BL1_3 | |
| 2 | AL2_3 | | BL2_3 | |
| 3 | AL3_3 | | BL3_3 | |
| ⋮ | ⋮ | | ⋮ | |
| 1080 | AL1080_1 | | BL1080_3 | |

| | | | | |
|---|---|---|---|---|
| 1 | AL1_4 | | BL1_4 | |
| 2 | AL2_4 | | BL2_4 | |
| 3 | AL3_4 | | BL3_4 | |
| ⋮ | ⋮ | | ⋮ | |
| 1080 | AL1080_4 | | BL1080_4 | |

FIG.6E

| | | | | |
|---|---|---|---|---|
| 1 | AL1_1 | AR1_1 | BL1_1 | BR1_1 |
| 2 | AL2_1 | AR2_1 | BL2_1 | BR2_1 |
| 3 | AL3_1 | AR3_1 | BL3_1 | BR3_1 |
| ⋮ | ⋮ | ⋮ | ⋮ | ⋮ |
| 1080 | AL1080_1 | AR1080_1 | BL1080_1 | BR1080_1 |

| | | | | |
|---|---|---|---|---|
| 1 | AL1_2 | AR1_2 | BL1_2 | BR1_2 |
| 2 | AL2_2 | AR2_2 | BL2_2 | BR2_2 |
| 3 | AL3_2 | AR3_2 | BL3_2 | BR3_2 |
| ⋮ | ⋮ | ⋮ | ⋮ | ⋮ |
| 1080 | AL1080_2 | AR1080_2 | BL1080_2 | BR1080_2 |

| | | | | |
|---|---|---|---|---|
| 1 | AL1_3 | AR1_3 | BL1_3 | BR1_3 |
| 2 | AL2_3 | AR2_3 | BL2_3 | BR2_3 |
| 3 | AL3_3 | AR3_3 | BL3_3 | BR3_3 |
| ⋮ | ⋮ | ⋮ | ⋮ | ⋮ |
| 1080 | AL1080_1 | AR1080_3 | BL1080_3 | BR1080_3 |

| | | | | |
|---|---|---|---|---|
| 1 | AL1_4 | AR1_4 | BL1_4 | BR1_4 |
| 2 | AL2_4 | AR2_4 | BL2_4 | BR2_4 |
| 3 | AL3_4 | AR3_4 | BL3_4 | BR3_4 |
| ⋮ | ⋮ | ⋮ | ⋮ | ⋮ |
| 1080 | AL1080_4 | AR1080_4 | BL1080_4 | BR1080_4 |

MEMORY, MEMORY ADDRESSING METHOD, AND DISPLAY DEVICE INCLUDING THE MEMORY

CROSS-REFERENCE TO RELATED APPLICATION

This application claims priority to and the benefit of Korean Patent Application No. 10-2012-0070928 filed in the Korean Intellectual Property Office on Jun. 29, 2012, the entire contents of which are incorporated herein by reference.

BACKGROUND (a) Field

Exemplary embodiments of the present invention relate to a memory, a memory addressing method, and a display device including the same.

(b) Description of the Related Art

When a display device displays two different images (A, B), image data input to the display device includes a source signal of the image A and a source signal of the image B. When the display device displays two images A and B for a stereoscopic image, bandwidth of the display device is significantly increased.

To handle the wide bandwidth, two image data sets are stored by using a plurality of memories. The display device may include a memory A for storing the image data A and a memory B for storing the image data B.

At this time, two image data sets are input to the display device, and the display device sequentially displays the image A and the image B. Thus, a read frequency that is a frequency at which the display device reads the image A and the image B from the memory A and the memory B, is double that of a write frequency that is a frequency at which the image data A and B are written to the memory A and the memory B, respectively.

That is, the bandwidth of the read frequency is double that of the bandwidth of the write frequency such that the bandwidth of the read frequency may exceed an operation region of the memory. Also, the bandwidth of the read frequency and the bandwidth of the write frequency may be different in the same memory such that it is difficult to actually manufacture the memory A and the memory B.

The above information disclosed in this Background section is only for enhancement of understanding of the background of the invention, and therefore it may contain information that does not form the prior art that is already known in this country to a person of ordinary skill in the art.

SUMMARY

A memory with reduced bandwidth, a memory addressing method, and a display device including the same are provided.

A memory according to an exemplary embodiment stores first image data and second image data of a line unit stored in a line buffer unit. The memory includes: at least a first DDR3 memory and a second DDR3 memory; and a rearrangement unit configured to: read the first image data of the line unit, divide the read first image data of the line unit, and write the divided first image data to a corresponding block among a plurality of blocks of each of the first DDR3 memory and the second DDR3 memory; read the second image data of the line unit, divide the read second image data of the line unit, and write the divided second image data to another corresponding block among the plurality of blocks of each of the first DDR3 memory and the second DDR3 memory. A first image is displayed according to the first image data, and a second image is displayed according to the second image data.

The first image data of the line unit may include first view point image data of the first image and second view point image data of the first image, and the second image data of the line unit may include first view point image data of the second image and second view point image data of the second image.

Each of the first DDR3 memory and the second DDR3 memory may include a first block, a second block, a third block, and a fourth block, and the rearrangement unit may be configured to: divide the first view point image data included in the first image data of the line unit and write the divided first view point image data to the first block of the first DDR3 memory and the first block of the second DDR3 memory; and divide the second view point image data included in the first image data of the line unit and write the divided second view point image data to the second block of the first DDR3 memory and the second block of the second DDR3 memory.

The rearrangement unit may be configured to: divide the first view point image data included in the second image data of the line unit and write the divided first view point image data to the third block of the first DDR3 memory and the third block of the second DDR3 memory; and divide the second view point image data included in the second image data of the line unit and write the divided second view point image data to the fourth block of the first DDR3 memory and the fourth block of the second DDR3 memory.

The first image data of the line unit of an n-th frame of the first image data may include the first view point image data of the first image, and the second image data of the line unit of the n-th frame of the second image data may include the first view point image data of the second image. The first image data of the line unit of the (n+1)-th frame of the first image data may include the second view point image data of the first image, and the second image data of the line unit of the (n+1)-th frame of the second image data may include the second view point image data of the second image.

The memory may further include a third DDR3 memory and a fourth DDR3 memory, and each of the first to fourth DDR3 memories may include the first to fourth blocks. The rearrangement unit may be configured to divide the first image data of the line unit of the n-th frame of the first image data and write the divided first image data to the first block of the first DDR3 memory, the first block of the second DDR3 memory, the first block of the third DDR3 memory, and the first block of the fourth DDR3 memory.

The rearrangement unit may be configured to divide the second image data of the line unit of the n-th frame of the second image data and write the divided second image data to the third block of the first DDR3 memory, the third block of the second DDR3 memory, the third block of the third DDR3 memory, and the third block of the fourth DDR3 memory.

The rearrangement unit may be configured to divide the first image data of the line unit of the (n+1)-th frame of the first image data and write the divided first image data to the second block of the first DDR3 memory, the second block of the second DDR3 memory, the second block of the third DDR3 memory, and the second block of the fourth DDR3 memory.

The rearrangement unit may be configured to divide the second image data of the line unit of the (n+1)-th frame of the second image data and write the divided second image data to the fourth block of the first DDR3 memory, the fourth block of the second DDR3 memory, the fourth block of the third DDR3 memory, and the fourth block of the fourth DDR3 memory.

The rearrangement unit may be configured to divide the read first image data of the line unit and the read second image data of the line unit according to a quantity of the DDR3 memories.

A memory addressing method according to another exemplary embodiment addresses first image data and second image data of a line unit stored in a line buffer unit to at least two memories including a first DDR3 memory and a second DDR3 memory. The memory addressing method includes a) reading the first image data of the line unit and dividing the read first image data of the line unit, and writing the divided first image data to a first address of a corresponding block among a plurality of blocks of each of the first DDR3 memory and the second DDR3 memory, and b) reading the second image data of the line unit and dividing the read second image data of the line unit, and writing the divided second image data to the first address of another corresponding block among the plurality of blocks of each of the first DDR3 memory and the second DDR3 memory, wherein a first image is displayed according to the first image data, and a second image is displayed according to the second image data.

The method may further include c) reading the first image data of the next line unit of the first image data of the line unit and dividing the read first image data of the next line unit, and writing the divided first image data to a second address of a corresponding block of each of the first DDR3 memory and the second DDR3 memory, and d) reading the second image data of the next line unit of the second image data of the line unit and dividing the read second image data of the next line unit, and writing the divided second image data to the second address of another corresponding block of each of the first DDR3 memory and the second DDR3 memory.

The first image data of the line unit may include first view point image data of the first image and second view point image data of the first image, and the second image data of the line unit may include first view point image data of the second image and second view point image data of the second image. Each of the first DDR3 memory and the second DDR3 memory may include a first block, a second block, a third block, and a fourth block, and the method may further include: dividing the first view point image data included in the first image data of the line unit and writing the divided first view point image data to the first address of the first block of the first DDR3 memory and the first address of the first block of the second DDR3 memory; and dividing the second view point image data included in the first image data of the line unit and writing the divided second view point image data to the first address of the second block of the first DDR3 memory and the first address of the second block of the second DDR3 memory.

The method may further include: dividing the first view point image data included in the second image data of the line unit and writing the divided first view point image data to the first address of the third block of the first DDR3 memory and the first address of the third block of the second DDR3 memory; and dividing the second view point image data included in the second image data of the line unit and writing the divided second view point image data to the first address of the fourth block of the second DDR3 memory and the first address of the fourth block of the second DDR3 memory.

The method may further include: dividing the first view point image data included in the first image data of the next line unit and writing the divided first view point image data to the second address of the first block of the first DDR3 memory and the second address of the first block of the second DDR3 memory; and dividing the second view point image data included in the first image data of the next line unit and writing the divided second view point image data to the second address of the second block of the first DDR3 memory and the second address of the second block of the second DDR3 memory.

The method may further include: dividing the first view point image data included in the second image data of the next line unit and writing the divided first view point image data to the second address of the third block of the first DDR3 memory and the second address of the third block of the second DDR3 memory; and dividing the second view point image data included in the second image data of the next line unit and writing the divided second view point image data to the second address of the fourth block of the first DDR3 memory and the second address of the fourth block of the second DDR3 memory.

The first image data of the line unit of the n-th frame of the first image data may include the first view point image data of the first image, and the second image data of the line unit of the n-th frame of the second image data may include the first view point image data of the second image.

The at least two memories may further include a third DDR3 memory and a fourth DDR3 memory, each of the first to fourth DDR3 memories includes a first block, a second block, a third block, and a fourth block, and the method may further include dividing the first image data of the line unit of the n-th frame of the first image data and writing the divided first image data to the first address of the first block of the first DDR3 memory, the first address of the first block of the second DDR3 memory, the first address of the first block of the third DDR3 memory, and the first address of the first block of the fourth DDR3 memory.

The method may further include dividing the second image data of the line unit of the n-th frame of the second image data and writing the divided second image data to the first address of the third block of the first DDR3 memory, the first address of the third block of the second DDR3 memory, the first address of the third block of the third DDR3 memory, and the first address of the third block of the fourth DDR3 memory.

The first image data of the line unit of the (n+1)-th frame of the first image data may include the second view point image data of the first image, and the second image data of the line unit of the (n+1)-th frame of the second image data may include the second view point image data of the second image.

The at least two memories may further include a third DDR3 memory and a fourth DDR3 memory, each of the first to fourth DDR3 memories may include a first block, a second block, a third block, and a fourth block, and the method may further include c) dividing the first image data of the line unit of the (n+1)-th frame of the first image data and writing the divided first image data to the first address of the second block of the first DDR3 memory, the first address of the second block of the second DDR3 memory, the first address of the second block of the third DDR3 memory, and the first address of the second block of the fourth DDR3 memory.

The method may further include d) dividing the second image data of the line unit of the n-th frame of the second image data and writing the divided second image data to the first address of the fourth block of the first DDR3 memory, the first address of the fourth block of the second DDR3 memory, the first address of the fourth block of the third DDR3 memory, and the first address of the fourth block of the fourth DDR3 memory.

A display device according to an exemplary embodiment displays a first image and a second image according to first image data and second image data. The display device includes: a line buffer unit for respectively storing the first image data and the second image data as a line unit; a memory including at least a first DDR3 memory and a second DDR3 memory, configured to read the first image data of the line unit, divide the read first image data of the line unit, and write the divided first image data to a corresponding block among a plurality of blocks of each of the first DDR3 memory and the second DDR3 memory, and read the second image data of the line unit, divide the read second image data of the line unit, and write the divided second image data to another corresponding block among the plurality of blocks of each of the first DDR3 memory and the second DDR3 memory; and a display unit including a plurality of pixels for emitting light according to the image data stored in the memory.

The first image data of the line unit may include a first view point image data of the first image and a second view point image data of the first image, the second image data of the line unit may include first view point image data of the second image and second view point image data of the second image, and each of the first DDR3 memory and the second DDR3 memory may include a first block, a second block, a third block, and a fourth block.

The memory may be configured to: divide the first view point image data included in the first image data of the line unit, and write the divided first view point image data to the first block of the first DDR3 memory and the first block of the second DDR3 memory; divide the second view point image data included in the first image data of the line unit, and write the divided second view point image data to the second block of the first DDR3 memory and the second block of the second DDR3 memory; divide the first view point image data included in the second image data of the line unit, and write the divided first view point image data to the third block of the first DDR3 memory and the third block of the second DDR3 memory; and divide the second view point image data included in the second image data of the line unit, and write the divided second view point image data to the fourth block of the first DDR3 memory and the fourth block of the second DDR3 memory.

The display device may further include a plurality of pixels configured to sequentially emit light according to the data written to the first block of the first DDR3 memory and the first block of the second DDR3 memory, the second block of the first DDR3 memory and the second block of the second DDR3 memory, the third block of the first DDR3 memory and the third block of the second DDR3 memory, and the fourth block of the first DDR3 memory and the fourth block of the second DDR3 memory.

The plurality of pixels may include a first group of pixels and a second group of pixels, wherein: the first group of pixels may be configured to sequentially emit light according to half of the data written to the first block of the first DDR3 memory and the first block of the second DDR3 memory, the second block of the first DDR3 memory and the second block of the second DDR3 memory, the third block of the first DDR3 memory and the third block of the second DDR3 memory, and the fourth block of the first DDR3 memory and the fourth block of the second DDR3 memory; and the second group of pixels may be configured to sequentially emit light according to the remaining half of the data written to the first block of the first DDR3 memory and the first block of the second DDR3 memory, the second block of the first DDR3 memory and the second block of the second DDR3 memory, the third block of the first DDR3 memory and the third block of the second DDR3 memory, and the fourth block of the first DDR3 memory and the fourth block of the second DDR3 memory.

The first image data of the line unit of the n-th frame of the first image data may include the first view point image data of the first image, the second image data of the line unit of the n-th frame of the second image data may include the first view point image data of the second image, the first image data of the line unit of the (n+1)-th frame of the first image data may include the second view point image data of the first image, and the second image data of the line unit of the (n+1)-th frame of the second image data may include the second view point image data of the second image.

The memory may further include a third DDR3 memory and a fourth DDR3 memory, each of the first to fourth DDR3 memories may include the first to fourth blocks, and the memory may be configured to: divide the first image data of the line unit of the n-th frame of the first image data and write the divided first image data to the first block of the first DDR3 memory, the first block of the second DDR3 memory, the first block of the third DDR3 memory, and the first block of the fourth DDR3 memory; divide the second image data of the line unit of the n-th frame of the second image data and write the divided second image data to the third block of the first DDR3 memory, the third block of the second DDR3 memory, the third block of the third DDR3 memory, and the third block of the fourth DDR3 memory; divide the first image data of the line unit of the (n+1)-th frame of the first image data and write the divided first image data to the second block of the first DDR3 memory, the second block of the second DDR3 memory, the second block of the third DDR3 memory, and the second block of the fourth DDR3 memory; and divide the second image data of the line unit of the (n+1)-th frame of the second image data and write the divided second image data to the fourth block of the first DDR3 memory, the fourth block of the second DDR3 memory, the fourth block of the third DDR3 memory, and the fourth block of the fourth DDR3 memory.

The display device may further include a plurality of pixels configured to sequentially emit light according to the data written to the first block of each of the first to fourth DDR3 memories, the second block of each of the first to fourth DDR3 memories, the third block of each of the first to fourth DDR3 memories, and the fourth block of each of the first to fourth DDR3 memories.

The display device may further include a plurality of pixels including a first group of pixels and a second group of pixels, wherein: the first group of pixels may be configured to sequentially emit light according to half of the data written to the first block of each of the first to fourth DDR3 memories, the second block of each of the first to fourth DDR3 memories, the third block of each of the first to fourth DDR3 memories, and the fourth block of each of the first to fourth DDR3 memories; and the second group of pixels may be configured to sequentially emit light according to the remaining half of the data written to the first block of each of the first to fourth DDR3 memories, the second block of each of the first to fourth DDR3 memories, the third block of each of the first to fourth DDR3 memories, and the fourth block of each of the first to fourth DDR3 memories.

The display unit may further include a plurality of scan lines for transmitting a plurality of scan signals and a plurality of data lines for transmitting a plurality of data signals to the first group of pixels and the second group of pixels. A light emitting period in which the first group of pixels emit light according to a plurality of written data signals and a scan period in which a plurality of data signals are transmitted to the second group of pixels, overlap each other.

Each pixel of the first group of pixels and the second group of pixels may include a driving transistor to which a driving current according to the written data signal flows, and an organic light emitting diode (OLED) coupled to the driving transistor and being configured to emit light according to the driving current. During a reset period for resetting an anode voltage of the organic light emitting diode (OLED), a first power source voltage applied to the driving transistor is lower than a second power source voltage applied to a cathode of the organic light emitting diode (OLED).

Each of the first group of pixels and the second group of pixels may further include a capacitor coupled to a gate electrode of the driving transistor and coupled to the first power source voltage, and during a compensation period in which the driving transistor is diode-connected, the capacitor is stored with a threshold voltage of the driving transistor.

A level of the first power source voltage during the light emitting period may be higher than that of the first power source voltage of the reset period, the compensation period, and the scan period.

Each of the plurality of pixels may include an organic light emitting diode (OLED), a driving transistor coupled to a driving voltage and being configured to supply a driving current to the organic light emitting diode (OLED), a compensation capacitor coupled to the gate electrode of the driving transistor, and a first storage capacitor and a second storage capacitor configured to selectively electrically couple to or decouple from the compensation capacitor, and the data voltage may be stored according to the data signal corresponding to the first storage capacitor in a first period, and the organic light emitting diode (OLED) may emit light according to the driving current flowing to the driving transistor by the data voltage stored in the second storage capacitor in a second period.

According to the embodiments, the memory with reduced bandwidth, the memory addressing method, and the display device are provided.

BRIEF DESCRIPTION OF THE DRAWINGS

FIG. 3A is a view showing the first image data of one line unit and the second image data of one line unit that are written to a first DDR3 memory and a second DDR3 memory.

FIG. 3B is a view showing the first image data of two line units written to a first DDR3 memory and a second DDR3 memory.

FIG. 3C is a view showing the first image data and the second image data of one frame unit written to a first DDR3 memory and a second DDR3 memory.

FIG. 6A is a view showing the first image data of a line unit and the second image data of a line unit that are written in a third DDR3 memory to a sixth DDR3 memory.

FIG. 6B is a view showing the first left-eye image data of a next line unit and the second left-eye image data of a next line unit written in a third DDR3 memory to a sixth DDR3 memory.

FIG. 6C is a view showing the first left-eye image data of a second next line unit and the second left-eye image data of a second next line unit written in a third DDR3 memory to a sixth DDR3 memory.

FIG. 6D is a view showing the first left-eye image data of one frame unit and the second left-eye image data of one frame unit written in a third DDR3 memory to a sixth DDR3 memory.

FIG. 6E is a view showing the first left-eye image data of one frame unit and the second left-eye image data of one frame unit, and the first left-eye image data of a next frame unit and the second left-eye image data of a next frame unit written in a third DDR3 memory to a sixth DDR3 memory.

DETAILED DESCRIPTION OF THE EMBODIMENTS

Figure 1:
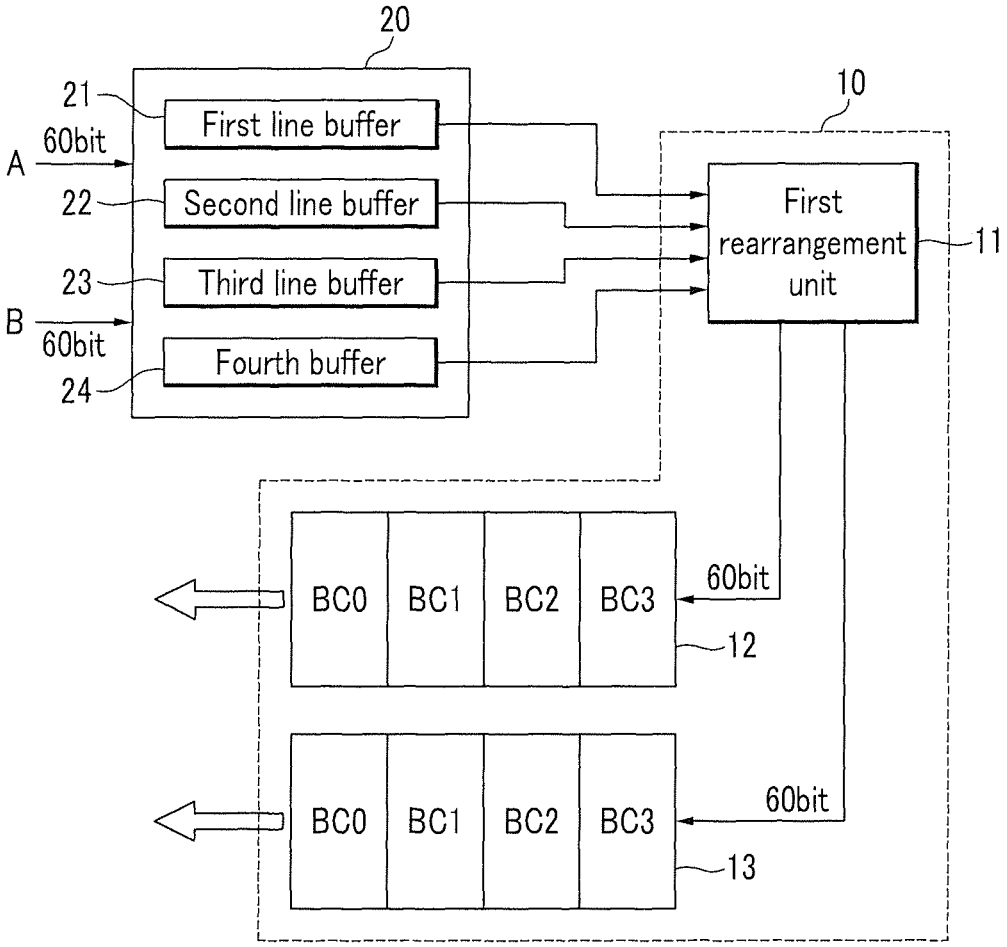
FIG. 1 is a view showing a memory according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element.

In addition, unless explicitly described to the contrary, the word "comprise" and variations such as "comprises" or "comprising" will be understood to imply the inclusion of stated elements but not the exclusion of any other elements.

Next, exemplary embodiments of the present invention will be described with reference to the accompanying drawings. In exemplary embodiments of the present invention, a memory for displaying an image of full high density (HD) image quality, a memory addressing method, and a display device including the same are provided. It is assumed that the full HD image quality has a resolution of 1920×1080. However, this assumption is only one example to explain the present invention.

In addition, it is assumed that an exemplary embodiment of the present invention relates to a memory for displaying two images A and B of different kinds, a memory addressing method, and a display device including the same. The image is displayed and recognized using the entire display unit of the display device, and the image displayed using the entire display unit is referred to as one frame.

In an exemplary embodiment of the present invention, one frame for displaying a stereoscopic image includes a left-eye image and a right-eye image, and the display device sequentially displays the left-eye image and the right-eye image according to a time-division driving method. The left-eye image represents an image recognized by a left eye when a view point (hereinafter, a base view point of the image) showing an object is a left eye, and the right-eye image represents an image recognized by a right eye when the base view point of the image is the right eye.

The left-eye image displayed by the display unit is referred to as a first half frame, and the right-eye image displayed by the display unit is referred to as the second half frame. Accordingly, one frame unit image includes the first half frame and the second half frame.

The image of one frame of the above-described full HD image quality may have a 1920×1080 resolution, wherein the first half frame may have a resolution of 960×1080, and the second half frame may have a resolution of 960×1080. In real full HD image quality, the first half frame and the second half frame each provide full HD image quality. Accordingly, the first half frame and the second half frame each provide the 1920×1080 resolution. Accordingly, in this case, one frame does not include the first half frame and the second half frame, but one of two frames is the first frame representing the left-eye image, and the other is the second frame representing the right-eye image.

Next, the first half frame, the second half frame, the first frame, and the second frame are divided according to image quality.

Firstly, an exemplary embodiment related to a memory operated by receiving the image data according to the full HD image quality, the memory addressing method, and the display device including the same will be described. The image data includes an arrangement of a plurality of grayscale data representing each brightness of a plurality of pixels forming the display unit.

In an exemplary embodiment of the present invention, the driving method sequentially displays the left-eye image and the right-eye image of the image A and the image B. Hereafter, the image data representing the image A is referred to as the first image data, and the image data representing the image B is referred to as the second image data. The first image data includes the first left-eye image data representing the left-eye image of the image A and the first right-eye image data representing the right-eye image of the image A. The second image data includes the second left-eye image data representing the left-eye image of the image B and the second right-eye image data representing the right-eye image of the image B.

FIG. 1 is a view of a memory according to an exemplary embodiment of the present invention.

A memory 10 respectively reads first image data (AL+AR) of a line unit and second image data (BL+BR) of the line unit stored in a line buffer unit 20, rearranges the image data of the read line unit, and writes the rearranged image data.

In detail, the memory 10 reads the first image data (AL+AR) of the line unit, rearranges and writes the first left-eye image data (AL) among the first image data (AL+AR) of the line unit, and rearranges and writes the first right-eye image data (AR).

Also, the memory 10 reads the second image data (BL+BR) of the line unit, rearranges and writes the second left-eye image data (BL) of the second image data (BL+BR) of the line unit, and rearranges and writes the second right-eye image data (BR).

The memory 10 reads the image data of the line unit from the line buffer unit 20 by 120 bit units.

The line buffer unit 20 receives two first image data (IDA) and two second image data (IDB) in parallel. At this time, two image data are respectively input by 60 bit units. The line buffer unit 20 includes first and second line buffers 21 and 22 for storing the first image data (IDA) by the line unit, and third and fourth line buffers 23 and 24 for storing the second image data (IDB) by the line unit. The line unit includes a group of a plurality of pixel data according to a transverse resolution.

For example, in the case of the full HD 1920×1080 resolution, the arrangement of 1920 grayscale data represents one line. Accordingly, the first line buffer 21 stores the left-eye image data including 960 grayscale data and the right-eye image data including 960 grayscale data. The second line buffer 22, the third line buffer 23, and the fourth line buffer 24 are operated substantially the same manner.

The memory 10 divides the image data of the line unit respectively stored to the first to fourth line buffers 21-24 according to a display sequence by 120 bits and stores them to two DDR3 memories or other suitable memories. The display sequence refers to a sequence with which the two images A and B are displayed.

According to an exemplary embodiment of the present invention, the memory 10 reads and divides the first image data from the line buffer storing the first image data of the line unit among the first line buffer 21 and the second line buffer 22, thereby dividing and storing the first image data to two DDR3 memories. Next, the second image data is read and divided from the line buffer storing the second image data of the line unit among the third line buffer 23 and the fourth line buffer 24, and the second image data is divided and stored to two DDR3 memories.

Among the first to fourth line buffers 21-24, a line buffer that does not store the first image data of the line unit or the second image data of the line unit may be currently written with the first image data or second image data.

The memory 10 according to an exemplary embodiment of the present invention includes a first rearrangement unit 11, a first DDR3 memory 12, and a second DDR3 memory 13.

The first DDR3 memory 12 is divided into four blocks (BC0-BC3), and the blocks respectively store the first left-eye image data, the first right-eye image data, the second left-eye image data, and the second right-eye image data.

The second DDR3 memory 13 is divided into four blocks (BC0-BC3), and the blocks respectively store the first left-eye image data, the first right-eye image data, the second left-eye image data, and the second right-eye image data.

The first and second DDR3 memories 12 and 13 are memories of a size capable of storing the image data of one frame, and each block has a size capable of storing ¼ of the image data of one frame. For example, the image data size of one frame according to the full HD resolution 1920×1080 is 1920×1080×10 bits (grayscale data)×3(RGB). Accordingly, the first and second DDR3 memories 12 and 13 respectively have a size of 1920×1080×10 bit (grayscale data)×3(RGB).

The first rearrangement unit 11 selects one among the line buffers storing the image data of the line unit among the first to fourth line buffers 21-24 according to the display sequence, and reads and rearranges the image data from the selected line buffer to write the image data to each block corresponding to the first DDR3 memory 12 and the second DDR3 memory 13.

Figure 2:
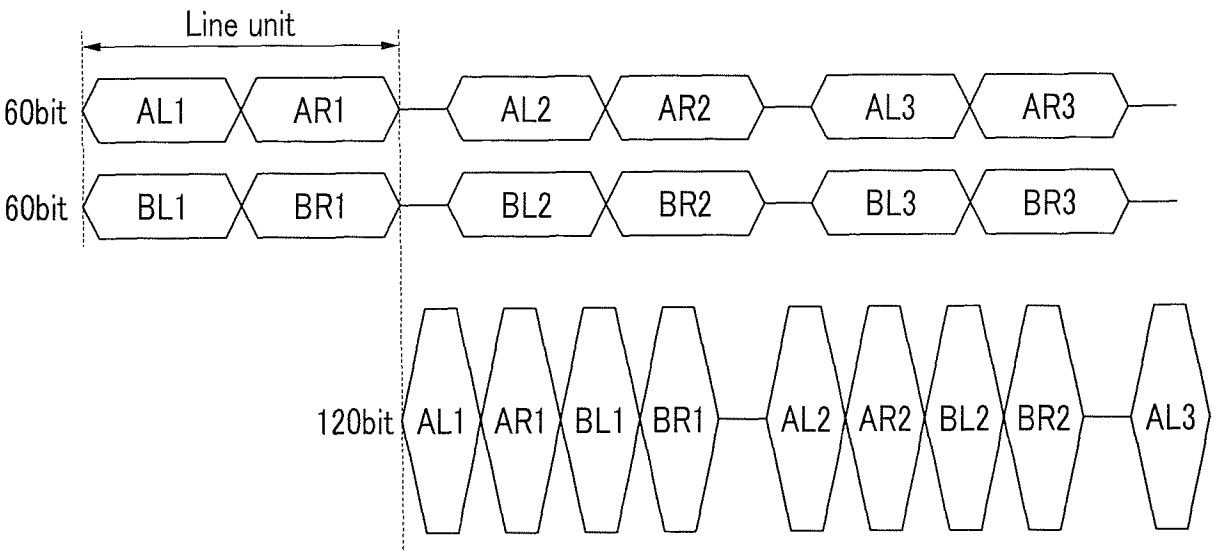
FIG. 2 is a view showing first image data and second image data output from a rearrangement unit along with the first image data of a plurality of line units and the second image data of a plurality of line units according to an exemplary embodiment of the present invention.

FIG. 2 is a view showing the rearranged first image data and the second image data output from a rearrangement unit along with the first image data of a plurality of line units and the second image data of a plurality of line units according to an exemplary embodiment of the present invention.

As shown in FIG. 2, the first image data (AL1, AR1, AL2, AR2, AL3, AR3, . . . ) of a plurality of line units are sequentially written to the first and second line buffers 21 and 22, and the second image data (BL1, BR1, BL2, BR2, BL3, BR3, . . . ) of a plurality of line units are sequentially written to the third and fourth line buffers 23 and 24.

For example, the first line buffer 21 stores the first image data AU and AR1of the line unit, and the third line buffer 23 stores the second image data BL1 and BR1 of the line unit. The second line buffer 22 and the fourth line buffer 24 may be respectively written with the first image data AL2 and AR2 and the second image data BL2 and BR2.

The first rearrangement unit 11 selects the first line buffer 21 among the first line buffer 21 and the third line buffer 23 according to the display sequence, reads the first image data AL1 and AR1 stored in the first line buffer 21, and writes them to a corresponding block in each of the first DDR3 memory 12 and the second DDR3 memory 13.

In detail, the first rearrangement unit 11 writes corresponding image data to a corresponding block (BCO) in each of the first DDR3 memory 12 and the second DDR3 memory 13 at 60 bits such that the image data is stored in the memory 10 through the first rearrangement unit 11 at 120 bits.

The first rearrangement unit 11 writes the first left-eye image data AL1 stored in the first line buffer 21 to a corresponding block (BCO) in each of the first DDR3 memory 12 and the second DDR3 memory 13, and then writes the first right-eye image data AR1to the block BC 1 in each of the first DDR3 memory 12 and the second DDR3 memory 13.

Next, the first rearrangement unit 11 writes the second left-eye image data BL1 stored in the third line buffer 23 to the block BC2 in each of the first DDR3 memory 12 and the second DDR3 memory 13, and then writes the second right-eye image data BR1 to the block BC3 in each of the first DDR3 memory 12 and the second DDR3 memory 13.

FIG. 3A is a view showing the first image data of one line unit and the second image data of one line unit that are written to the first DDR3 memory and the second DDR3 memory.

As shown in FIG. 3A, the image data (AL1_1) corresponding to half of the first left-eye image data AL1 of the line unit was written to an address 1 of the block BC0 of the first DDR3 memory 12, and the image data (AL1_2) corresponding to the other half is written to the address 1 of the block BC0 of the second DDR3 memory 13. The image data (AR1_1) corresponding to the half among the first right-eye image data AR1of the line unit is written to the address 1 of the block BC1 of the first DDR3 memory 12, and the image data (AR1_2) corresponding to the other half is written to the address 1 of the block BC1 of the second DDR3 memory 13.

The image data (BL1_1) corresponding to half among the second left-eye image data BL1 of the line unit is written to the address 1 of the block BC2 of the first DDR3 memory 12, and the image data (BL1_2) corresponding to the other half is written to the address 1 of the block BC2 of the second DDR3 memory 13. The image data (BR1_1) corresponding to half among the second right-eye image data BR1 of the line unit is written to the address 1 of the block BR3 of the first DDR3 memory 12, and the image data (BR1_2) corresponding to the other half is written to the address 1 of the block BR3 of the second DDR3 memory 13.

The first rearrangement unit 11 selects the second line buffer 22 among the second line buffer 22 and the fourth line buffer 24 by the same method according to the display method, reads the first image data AL2 and AR2 stored in the second line buffer 22, and writes them to a corresponding block in each of the first DDR3 memory 12 and the second DDR3 memory 13.

The first rearrangement unit 11 writes the first left-eye image data AL2 stored in the second line buffer 22 to the address 2 of a corresponding block (BCO) in each of the first DDR3 memory 12 and the second DDR3 memory 13, and then writes the first right-eye image data AR2 to the address 2 of the block BC 1 in each of the first DDR3 memory 12 and the second DDR3 memory 13.

Next, the first rearrangement unit 11 writes the second left-eye image data BL2 stored in the fourth line buffer 24 to the address 2 of the block BC2 in each the first DDR3 memory 12 and the second DDR3 memory 13, and then writes the second right-eye image data BR2 to the address 2 of the block BR3 in each of the first DDR3 memory 12 and the second DDR3 memory 13.

FIG. 3B is a view showing the first image data of two line units written to the first DDR3 memory 12 and the second DDR3 memory 13.

As shown in FIG. 3B, the first left-eye image data AL1 and AL 2, the first right-eye image data AR1 and AR 2, the second left-eye image data BL1 and BL2, and the second right-eye image data BR1 and BR2 are written to the first DDR3 memory 12 and the second DDR3 memory 13.

As described above, the first left-eye image data of the line unit, the first right-eye image data of the line unit, the second left-eye image data of the line unit, and the second right-eye image data of the line unit are divided by the first rearrangement unit 11 and are written to corresponding blocks in each of the first DDR3 memory 12 and the second DDR3 memory 13.

As described above, the first image data of one frame and the second image data of one frame are written to the first DDR3 memory 12 and the second DDR3 memory 13.

FIG. 3C is a view showing the first image data and the second image data of one frame unit written to the first DDR3 memory and the second DDR3 memory. In FIG. 3C, there are 1080 image data of the line unit according to the longitudinal resolution of 1920×1080. However, the present invention is not limited thereto.

As shown in FIG. 3C, the first left-eye image data of the half frame unit is divided and written to the block BC0 of the first DDR3 memory 12 and the block BC0 of the second DDR3 memory 13, and the first right-eye image data of the half frame unit is divided and written to the block BC1 of the first DDR3 memory 12 and the block BC1 of the second DDR3 memory 13.

Also, the second left-eye image data of the half frame unit is divided and written to the block BC2 of the first DDR3 memory 12 and the block BC2 of the second DDR3 memory 13, and the second right-eye image data of the half frame unit is divided and written to the block BR3 of the first DDR3 memory 12 and the block BR3 of the second DDR3 memory 13.

The image data stored in the first and second DDR3 memories 12 and 13 is read at 60 bits from each DDR3 memory to realize the full HD resolution. Accordingly, the image data is read from the memory 10 at 120 bits. Also, the image data is respectively written to each of the first and second DDR3 memories 12 and 13 from the line buffer unit 20 at 60 bits such that the image data is written to the memory 10 at 120 bits.

As described above, according to an exemplary embodiment of the present invention, in the full HD image quality, the write frequency and the read frequency of the DDR3 memory are the same.

Next, another exemplary embodiment related to a memory operated by the input of the image data according to the real full HD image quality, a memory addressing method, and a display device will be described.

Figure 4:
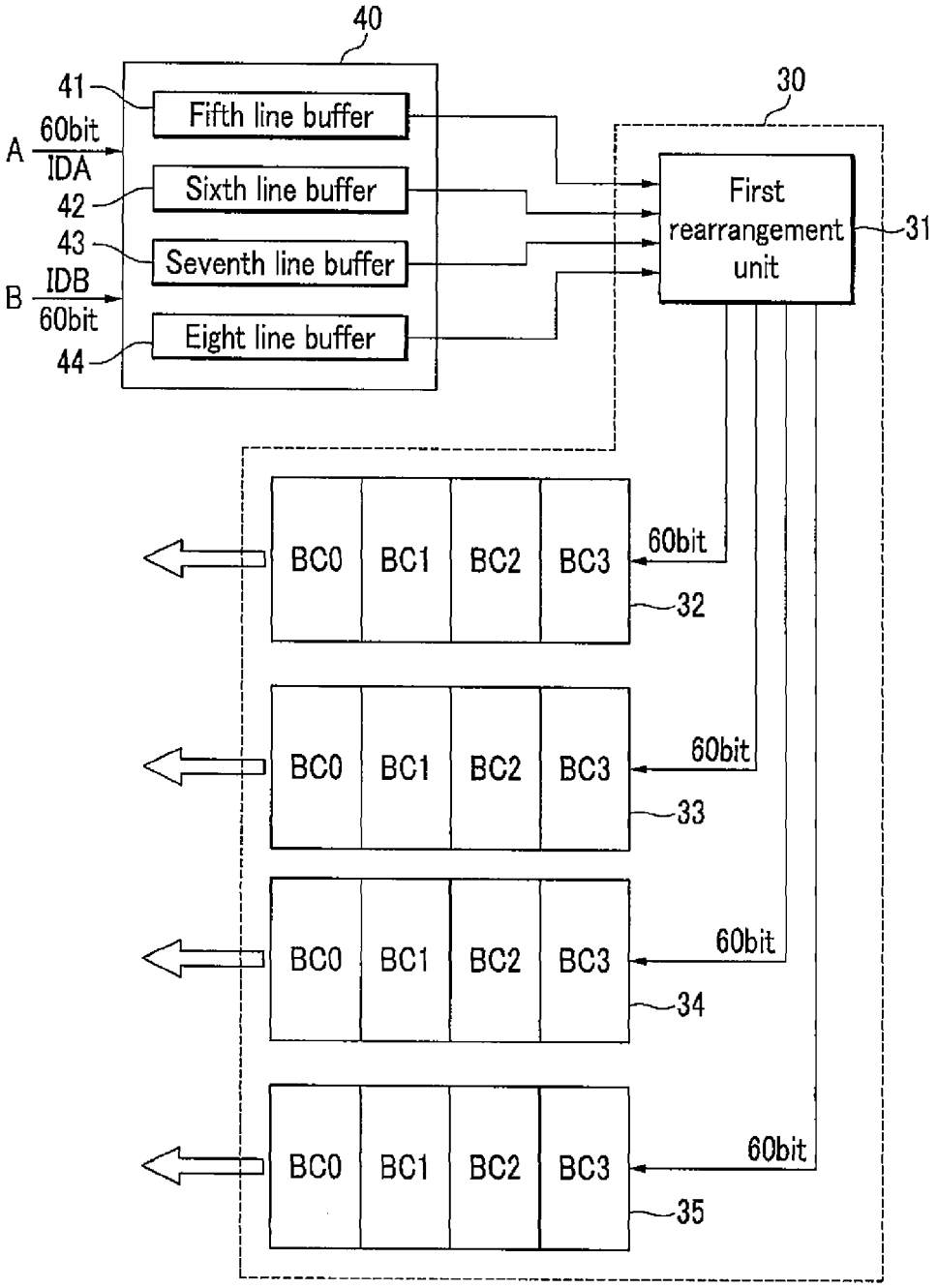
FIG. 4 is a view showing a memory according to another exemplary embodiment of the present invention.

FIG. 4 is a view of a memory according to another exemplary embodiment of the present invention. Differently from the above-described exemplary embodiment, the number of DDR3 memories is increased according to an increase in the resolution (doubling resolution).

A memory 30 includes third through sixth DDR3 memories (32, 33, 34, and 35).

The memory 30 respectively reads first image data (AL, AR) of the line unit and second image data (BL, BR) of the line unit stored in the line buffer unit 40, rearranges the image data of the line unit, and writes the rearranged image data.

In more detail, the memory 30 reads, rearranges, and writes the first left-eye image data (AL) of the line unit and the second left-eye image data (BL). Also, the memory 30 reads, rearranges, and writes the first right-eye image data (AR) of the line unit and the second right-eye image data (BR). The memory 30 reads the image data of the line unit from the line buffer unit 40 at 120 bits.

The line buffer unit 40 receives the first image data (IDA) and the second image data (IDB) in parallel. At this time, two image data are respectively input at 60 bits. The line buffer unit 40 includes fifth and sixth line buffers 41 and 42 for storing the first image data (IDA) by the line unit, and seventh and eighth line buffers 43 and 44 for storing the second image data (IDB) by the line unit. The line unit includes a group of a plurality of pixel data according to transverse resolution.

For example, in the case of the full HD 1920×1080 resolution, the arrangement of 1920 grayscale data becomes one line. Accordingly, the fifth line buffer 41 stores the left eye (or the right eye) image data of 1920 grayscale data. The sixth line buffer 42, the seventh line buffer 43, and the eighth line buffer 44 are substantially the same.

The memory 30 reads the image data of the line unit respectively stored in the fifth through eighth line buffers 41-44 at 120 bits according to the storing sequence and the display sequence, and divides and stores them to four DDR3 memories.

In another exemplary embodiment, only one of the left-eye image data and the right-eye image data exists in the line buffer by the increasing of the resolution, and the first image data and the second image data are input to the line buffer 40 in parallel, thereby the storing sequence and the display sequence are considered together.

For example, among the fifth to eighth line buffers 41 to 44, when the fifth and seventh line buffers 41 and 43 are stored with the first left-eye image data of the line unit and the second left-eye image data of the line unit, and the sixth and eighth line buffers 42 and 44 are stored with the image data, the image data is read from the left-eye image data of the fifth line buffer 41 according to the display sequence among the fifth and seventh line buffers 41 and 43.

According to another exemplary embodiment of the present invention, the memory 30 reads the first image data from the line buffer storing the first image data of the line unit among the fifth line buffer 41 and the sixth line buffer 42, and divides and stores them to four DDR3 memories. Next, the second image data is read from the line buffer storing the second image data of the line unit among the seventh line buffer 43 and the eighth line buffer 44, and is divided and stored to four DDR3 memories.

The line buffer in which the first image data of the line unit or the second image data of the line unit is not stored among the fifth to eighth line buffers 41-44, may be currently written with the first image data or the second image data.

The memory 30 according to another exemplary embodiment of the present invention includes the second rearrangement unit 31, the third DDR3 memory 32, the fourth DDR3 memory 33, the fifth DDR3 memory 34, and the sixth DDR3 memory 35.

The third DDR3 memory 32 is divided into four blocks (BC0-BC3), and each block is stored with the first left-eye image data, the first right-eye image data, the second left-eye image data, and the second right-eye image data. The fourth DDR3 memory 33 is divided into four blocks (BC0-BC3), and each block is stored with the first left-eye image data, the first right-eye image data, the second left-eye image data, and the second right-eye image data.

The fifth DDR3 memory 34 is divided into four blocks (BC0-BC3), and each block is stored with the first left-eye image data, the first right-eye image data, the second left-eye image data, and the second right-eye image data. The sixth DDR3 memory 35 is divided into four blocks (BC0-BC3), and each block is stored with the first left-eye image data, the first right-eye image data, the second left-eye image data, and the second right-eye image data. The third to sixth DDR3 memories 32-35 may have the same size as the DDR3 memory of the previous exemplary embodiment.

The second rearrangement unit 31 selects one among the line buffers including the image data of the line unit among the fifth to eighth line buffers 41-44 according to the storing sequence and the display sequence, and reads and rearranges the image data selected from the line buffer to write it to a corresponding block in each of the third to sixth DDR3 memories 32 to 35.

Figure 5:
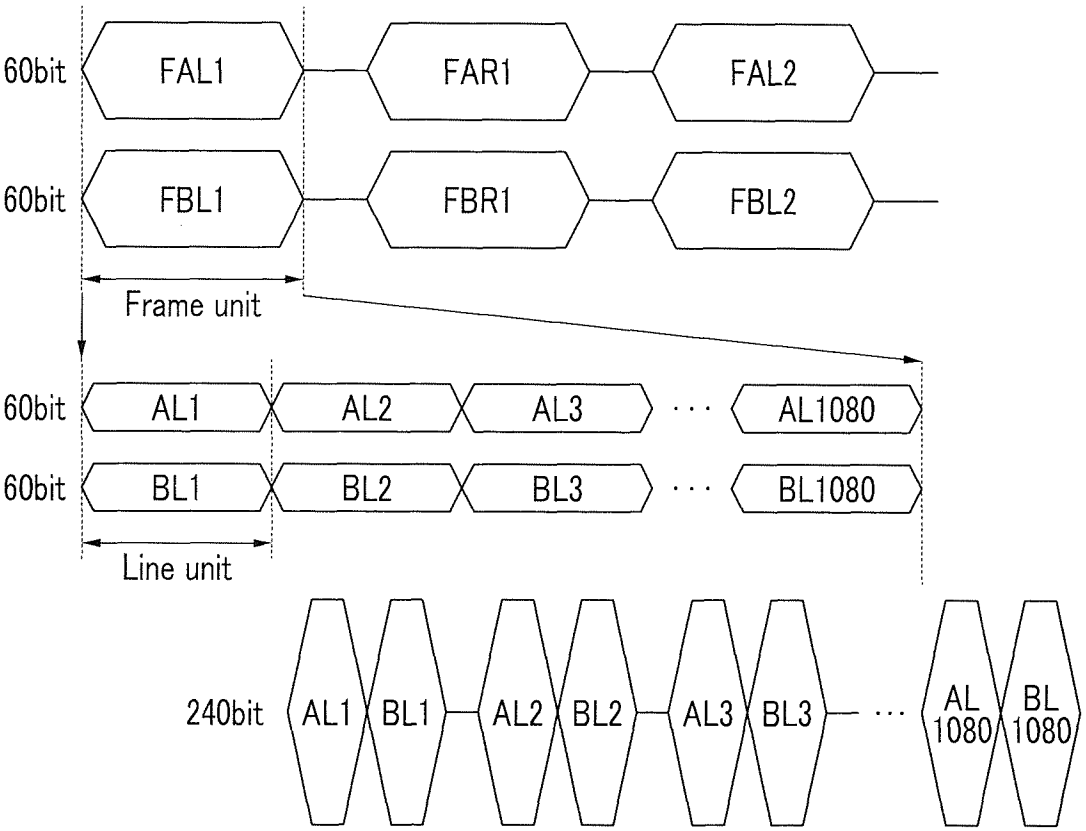
FIG. 5 is a view showing the first image data and the second image data output from a rearrangement unit along with the first image data of a plurality of frame units and the second image data of a plurality of frame units, and the first left-eye image data of a plurality of line units and the second left-eye image data of a plurality of line units according to an exemplary embodiment of the present invention.

FIG. 5 is a view showing the first image data and the second image data output from a rearrangement unit along with the first image data of a plurality of frame units and the second image data of a plurality of frame units, and the first left-eye image data of a plurality of line units and the second left-eye image data of a plurality of line units according to an exemplary embodiment of the present invention.

As shown in FIG. 5, each line unit image data of the first image data (FAL1, FAR1, FAL2, . . . ) of a plurality of frame units and the second image data (FBL1, FBR1, FBL2, . . . ) of a plurality of frame units is input to the line buffer 40.

FIG. 5 shows a plurality of line unit image data (AL1, AL2, AL3, . . . AL1080, BL1, BL2, BL3, . . . BL1080) of the first image data FAL1 of the frame unit and the second image data FBL1 of the frame unit. The plurality of line unit image data (AL1, AL2, AL3, . . . AL1080, BL1, BL2, BL3, . . . BL1080) are only shown to explain an exemplary embodiment, and a plurality of line unit image data of the first image data FAR1 of the next frame and the second image data FBR1 of the next frame are input.

A plurality of line unit image data (AL1, AL2, AL3, . . . AL1080) are sequentially written to the fifth and sixth line buffers 41 and 42, and the second image data (BL1, BL1, BL2, BL3, . . . BL1080) of a plurality of line units are sequentially written to the seventh and eighth line buffers 43 and 44.

For example, the fifth line buffer 41 is stored with the first left-eye image data AL1 of the line unit, and the seventh line buffer 43 is stored with the second left-eye image data BL1 of the line unit. The sixth line buffer 42 and the eighth line buffer 44 are respectively written with the first left-eye image data AL2 and the second left-eye image data BL2.

The second rearrangement unit 31 selects the fifth line buffer 41 from among the fifth line buffer 41 and the seventh line buffer 43 according to the display sequence, reads the first left-eye image data AL1 stored in the fifth line buffer 41, and writes it to a corresponding block in each of the third DDR3 memory 32 to the sixth DDR3 memory 35.

In more detail, the second rearrangement unit 31 writes data to each block (e.g., BCO) of the third DDR3 memory to the sixth DDR3 memory 32-35 at 60 bits, thereby the image data is written to the memory 30 through the second rearrangement unit 31 at 240 bits.

The second rearrangement unit 31 writes the first left-eye image data AL1 stored in the fifth line buffer 41 to a corresponding block (BCO) in each of the third DDR3 memory to the sixth DDR3 memory 32-35, and then writes the second left-eye image data BL1 stored in the seventh line buffer 43 to the block BC2 in each of the third to sixth DDR3 memories 32-35.

Next, the second rearrangement unit 31 writes the first left-eye image data AL2 stored in the sixth line buffer 42 to a corresponding block (BCO) in each of the third DDR3 memory to the sixth DDR3 memory 32-35, and then writes the second left-eye image data BL2 stored in the eighth line buffer 44 to the block BC2 in each of the third to sixth DDR3 memories 32-35.

By this method, the first left-eye image data FAL1 and the second left-eye image data FBL1 of one frame unit are written to the corresponding blocks (BCO) and (BC2) in each of the third DDR3 memory to the sixth DDR3 memory 32-35.

Next, by the same above-described method, the second rearrangement unit 31 writes the first right-eye image data FAR1 and the second right-eye image data FBR1 of the next frame unit to the blocks BC1 and BR3 in each of the third DDR3 memory to the sixth DDR3 memory 32-35.

FIG. 6A is a view showing the first image data of one line unit and the second image data of one line unit that are written to the third DDR3 memory through the sixth DDR3 memory.

As shown in FIG. 6A, the image data (AL1_1) corresponding to ¼ of the first left-eye image data AL1 of the line unit is written to the address 1 of the block BC0 of the third DDR3 memory 32, the image data (AL1_2) corresponding to another ¼ is written to the address 1 of the block BC0 of the fourth DDR3 memory 33, the image data (AL1_3) corresponding to another ¼ is written to the address 1 of the block BC0 of the fifth DDR3 memory 34, and the image data (AL1_4) corresponding to the remaining ¼ is written to the address 1 of the block BC0 of the sixth DDR3 memory 35.

The image data (BL1_1) corresponding to ¼ of the second left-eye image data BL1 of the line unit is written to the address 1 of the block BC2 of the third DDR3 memory 32, the image data (BL1_2) corresponding to another ¼ is written to the address 1 of the block BC2 of the fourth DDR3 memory 33, the image data (BL1_3) corresponding to another ¼ is written to the address 1 of the block BC2 of the fifth DDR3 memory 34, and the image data (BL1_4) corresponding to the remaining ¼ is written to the address 1 of the block BC2 of the sixth DDR3 memory 35.

As described above, the first left-eye image data AL1 and the second left-eye image data BL1 according to another exemplary embodiment is double the first left-eye image data and the second left-eye image data of the previous exemplary embodiment such that they are written to the block BC0 in each of the third to sixth DDR3 memories 32-35.

FIG. 6B is a view showing the first left-eye image data of a next line unit and the second left-eye image data of a next line unit written in the third DDR3 memory to the sixth DDR3 memory.

As shown in FIG. 6B, the image data (AL2_1) corresponding to ¼ of the first left-eye image data AL2 of the line unit is written to the address 2 of the block BC0 of the third DDR3 memory 32, the image data (AL2_2) corresponding to another ¼ is written to the address 2 of the block BC0 of the fourth DDR3 memory 33, the image data (AL2_3 ) corresponding to another ¼ is written to the address 2 of the block BC0 of the fifth DDR3 memory 34, and the image data (AL2_4) corresponding to the remaining ¼ is written to the address 2 of the block BC0 of the sixth DDR3 memory 35.

The image data (BL2_1) corresponding to ¼ of the second left-eye image data BL2 of the line unit is written to the address 2 of the block BC2 of the third DDR3 memory 32, the image data (BL2_2) corresponding to another ¼ is written to the address 2 of the block BC2 of the fourth DDR3 memory 33, the image data (BL2_3) corresponding to another ¼ is written to the address 2 of the block BC2 of the fifth DDR3 memory 34, and the image data (BL2_4) corresponding to the remaining ¼ is written to the address 2 of the block BC2 of the sixth DDR3 memory 35.

FIG. 6C is a view showing the first left-eye image data of a second next line unit and the second left-eye image data of a second next line unit written in the third DDR3 memory through the sixth DDR3 memory.

As previously described, the first left-eye image data AL3 of the line unit and the second left-eye image data BL3 of the line unit are written to the address 3 of the block BC0 and the address 3 of the block BC2 in each of the third through the sixth DDR3 memories 32-35.

FIG. 6D is a view showing the first left-eye image data of one frame unit and the second left-eye image data of one frame unit written in the third DDR3 memory through the sixth DDR3 memory.

According to the method shown in FIGS. 6A-6D, the first left-eye image data FAL1 and the second left-eye image data FBL1 of one frame are written to the block BC0 and block BC2 in each of the third through sixth DDR3 memories 32-35.

FIG. 6E is a view showing the first left-eye image data of one frame unit and the second left-eye image data of one frame unit, and the first left-eye image data of a next frame unit and the second left-eye image data of a next frame unit written in the third DDR3 memory through the sixth DDR3 memory.

As shown in FIG. 6E, the first left-eye image data FAL1 of one frame unit and the second left-eye image data FBL1 of one frame unit, and the first right-eye image data FAR1of the next frame unit and the second right-eye image data FBR1 of the next frame unit, are divided and written to all the blocks (BC0-BC3) of the third through sixth DDR3 memory 32-35.

The image data stored in the third through sixth DDR3 memories 32-35 are read from each DDR3 memory at 60 bits to realize the real full HD resolution. Accordingly, the image data is read from the memory 30 at 240 bits. Also, the image data is written from the line buffer unit 40 to each of the third through sixth DDR3 memories 32-35 at 60 bits such that the image data is written to the memory 30 at 240 bits.

As described above, according to another exemplary embodiment of the present invention, a memory in which the write frequency and the read frequency of the DDR3 memory are equal for the display of the real full HD image quality is provided.

Next, a display device applied with the memory according to one exemplary embodiment of the present invention and a method (hereinafter referred to as an addressing method) of writing the image data to the memory will be described.

Figure 7:
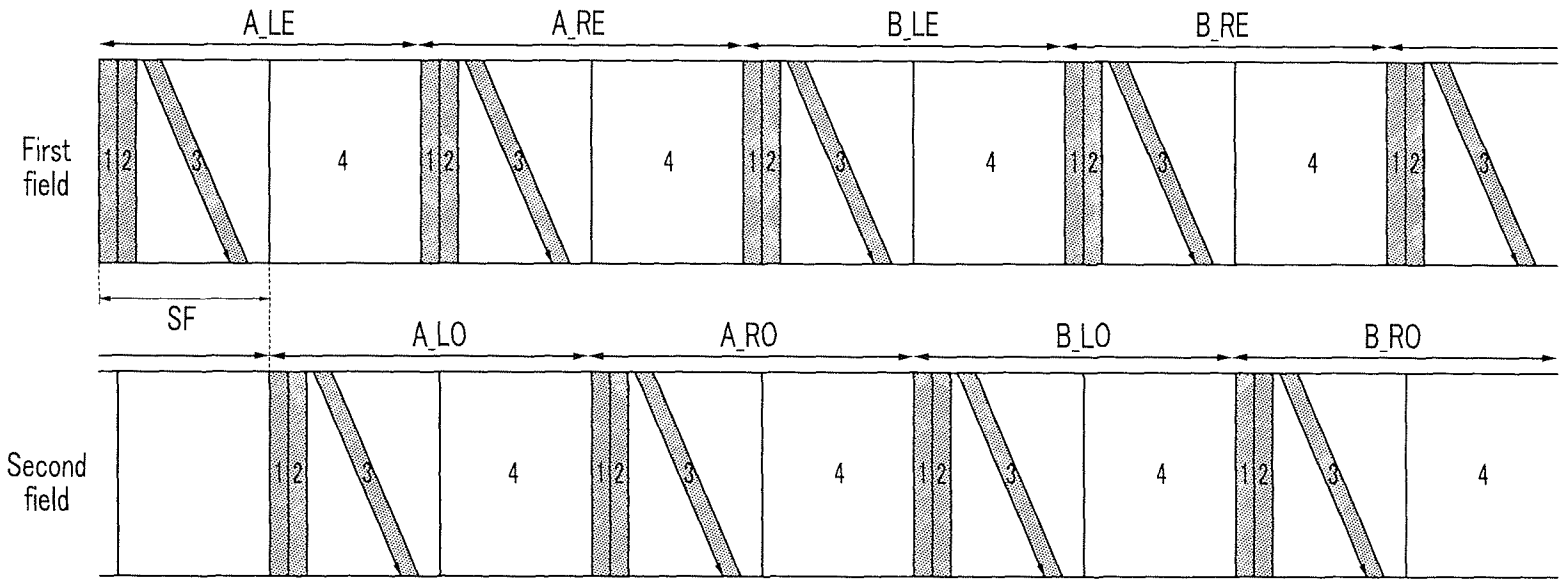
FIG. 7 is a view of a first driving method of a display device according to an exemplary embodiment of the present invention.

FIG. 7 is a view of a first driving method of a display device according to an exemplary embodiment of the present invention.

A panel of the display device operated according to the first driving method includes a first group of pixels and a second group of pixels. The first group of pixels light-emit during an odd-numbered frame of the display device among a plurality of pixels, and the second group of pixels light-emit during an even-numbered frame of the display device among the plurality of pixels. Hereafter, the plurality of odd-numbered frames are continuously arranged in a first field, and the plurality of even-numbered frames are continuously arranged in a second field.

The display device displays the left-eye image of the image A to display the stereoscopic image during the first half frame (A_LE) of the first field and the first half frame (A_LO) of the second field, and displays the right-eye image of the image A during the second half frame (A_RE) of the first field and the second half frame (A_RO) of the second field.

The display device displays the left-eye image of the image B following the image A during the first half frame (B_LE) of the first field and the first half frame (B_LO) of the second field, and displays the right-eye image of the image B during the second half frame (B_RE) of the first field and the second half frame (B_RO) of the second field.

However, the present invention is not limited thereto, and the right-eye image of the image A may be displayed earlier than the left-eye image, and the right-eye image of the image B may be displayed earlier than the left-eye image.

A period of one frame sequentially includes a reset period 1, a compensation period 2, a scan period 3, and a light emitting period 4.

The reset period 1 is a period for discharging charges charged to an organic light emitting diode (OLED). The compensation period 2 is a period for compensating a threshold voltage variation of a driving transistor for supplying the driving current to the organic light emitting diode (OLED). The scan period 3 is a period in which the data signal is written to the first group of pixels and the second group of pixels. A period (SF) may be set for the scan period 3 of a half frame of the first field to not be overlapped with a half frame of the adjacent second field.

Among the light emitting period 4 of the first group of pixels, a scan period 3 in which the data signal corresponding to the second group of pixels is written is generated. Likewise, among the light emitting period 4 of the second group of pixels, a scan period 3 in which the data signal corresponding to the first group of pixels is written is generated. Accordingly, the scan period 3 may be sufficiently obtained such that a temporal margin to drive the display panel is increased.

Also, the scan frequency may be decreased such that the bandwidth of a data driver for generating a data signal and transmitting it to a data line, and the bandwidth of a scan driver for generating a scan signal may be reduced, thereby reducing the cost of a circuit element.

Furthermore, a light emitting time 4 of the first group of pixels and the light emitting time 4 of the second group of pixels are dispersed such that a maximum current for the light emitting time is decreased, thereby reducing the size of a power supply circuit for supplying power to the display device.

According to the first driving method, half of the first left-eye image data of the half frame unit stored in the memory 10 is written to the first group of pixels during the scan period 3 of the first half frame (A_LE), and the first group of pixels emits light according to the first left-eye image data written during the light emitting period 4 of the first half frame (A_LE).

For example, the display unit is the full HD display panel having a plurality of pixels with a resolution of 1920×1080, and the first left-eye image data has a resolution of 960×1080. Here, the first left-eye image data of the half frame unit is divided in half and is written to the first group of pixels and the second group of pixels.

Half of the first left-eye image data of the half frame unit corresponds to 480 pixels. Accordingly, when writing the first left-eye image data of the half frame unit to the first group of pixels (960), the same first left-eye image data are written to two adjacent pixels.

Next, it is assumed that two adjacent pixels are written with the same image data when a number of the image data is half compared with a number of pixels. This is only an example for describing the present invention, and the present invention is not limited thereto.

The remaining half of the first left-eye image data of the half frame unit is written to the second group of pixels during the scan period 3 of the first half frame (A_LO), and the second group of pixels emit light according to the first left-eye image data during the light emitting period 4 of the first half frame (A_LO).

The half of the first right-eye image data of the half frame unit stored in the memory 10 are written to the first group of pixels during the scan period 3 of the second half frame (A_RE), and the first group of pixels emits light according to the written first right-eye image data during the light emitting period 4 of the second half frame (A_RE). The remaining half of the first right-eye image data of the half frame unit is written to the second group of pixels during the scan period 3 of the second half frame (A_RO), and the second group of pixels emit light according to the written first right-eye image data during the light emitting period 4 of the second half frame (A_RO).

The half of the second left-eye image data of the half frame unit stored in the memory 10 are written to the first group of pixels during the scan period 3 of the first half frame (B_LE), and the first group of pixels emits light according to the written second left-eye image data during the light emitting period 4 of the first half frame (B_LE). The remaining half of the second left-eye image data of the half frame unit is written to the second group of pixels during the scan period 3 of the first half frame (B_LO), and the second group of pixels emits light according to the written second left-eye image data during the light emitting period 4 of the first half frame (B_LO).

The half of the second right-eye image data of the half frame unit stored in the memory 10 are written to the first group of pixels during the scan period 3 of the second half frame (B_RE), and the first group of pixels emits light according to the written second right-eye image data during the light emitting period 4 of the second half frame (B_RE). The half of the second right-eye image data of the half frame unit are written to the second group of pixels during the scan period 3 of the second half frame (B_RO), and the second group of pixels emits light according to the written second right-eye image data during the light emitting period 4 of the second half frame (B_RO).

Differently from a full HD, in the case of the real full HD, the memory 30 receives the first left-eye image data of one frame unit, the first right-eye image data of one frame unit, the second left-eye image data of one frame unit, and the second right-eye image data of one frame unit.

Accordingly, the first left-eye image data of one frame unit may be respectively divided in half and written to the first group of pixels and the second group of pixels. Likewise, the first right-eye image data of one frame unit, the second left-eye image data of one frame unit, and the second right-eye image data of one frame unit may also be respectively divided and written to the first group of pixels and the second group of pixels.

The driving method shown in FIG. 7 is one example of the present invention, and the present invention is not limited thereto.

Figure 8:
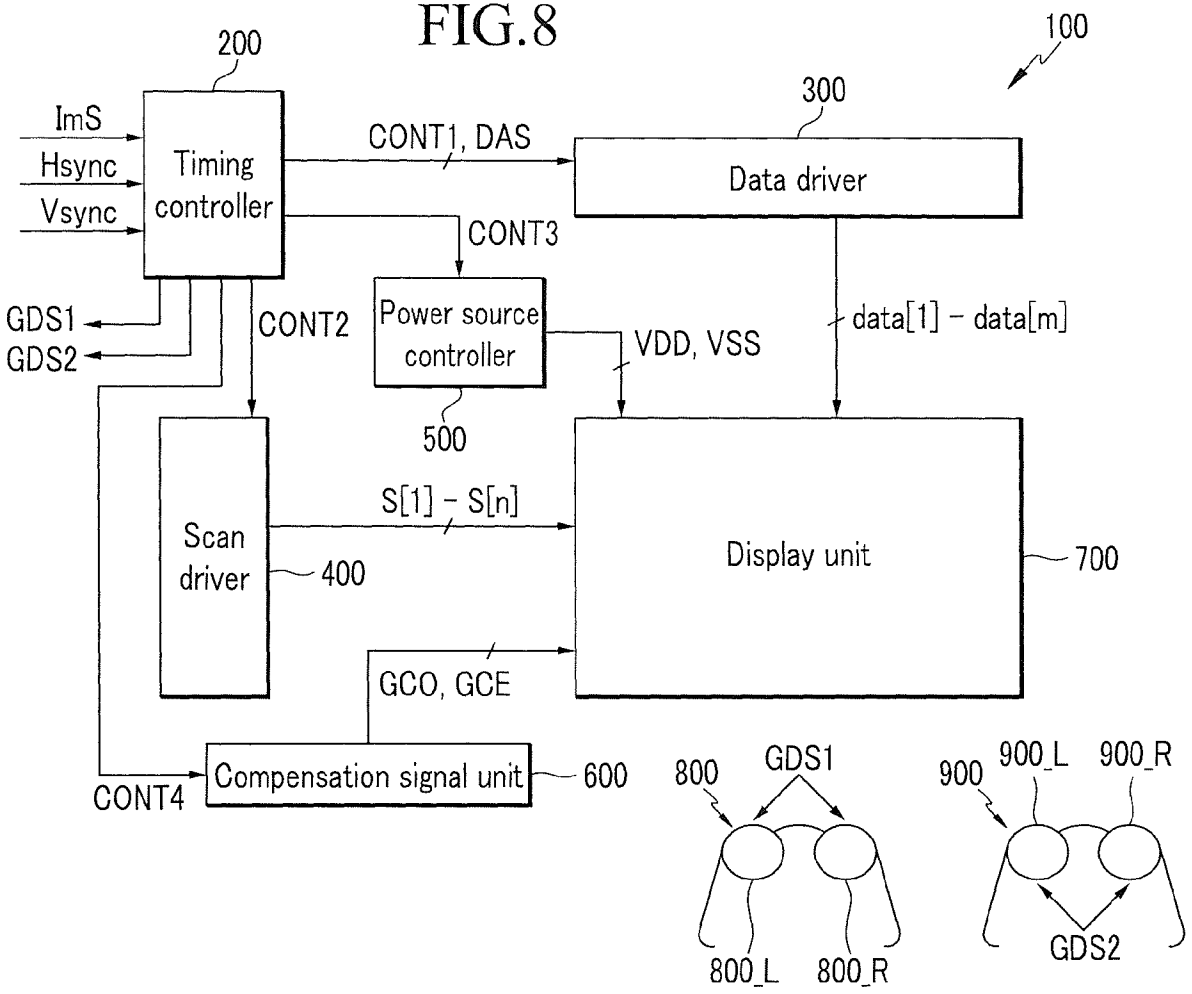
FIG. 8 is a view of a display device including a memory according to an exemplary embodiment of the present invention.

FIG. 8 is a view of a display device including a memory according to an exemplary embodiment of the present invention.

As shown in FIG. 8, the display device 100 includes a timing controller 200, a data driver 300, a scan driver 400, a power source controller 500, a compensation control signal unit 600, and a display unit 700.

It is assumed that the memory 10 or 30 and the line buffer unit 20 or 40 are included in the timing controller 200. However, the present invention is not limited thereto, only the line buffer unit 20 or 40 may be included in the timing controller 200, and the memory 10 or 30 may be separately formed.

The timing controller 200 receives a video signal (ImS) of which the first image data (IDA) and the second image data (IDB) are arranged in parallel, a vertical synchronization signal (Vsync), and a horizontal synchronization signal (Hsync), and generates first to fourth driving control signals (CONT1-CONT4) and a data signal (DAS).

The timing controller 200 stores the first image data (IDA) and the second image data (IDB) at the line buffers unit 20 or 40, and reads and arranges the image data from the memory 10 or 30 according to the display sequence to generate the data signal (DAS). The timing controller 200 generates the first driving control signal (CONT1) for controlling timing at which the data signal (DAS) is supplied to a plurality of data lines according to the vertical synchronization signal (Vsync) and the horizontal synchronization signal (Hsync), and transmits the first driving control signal (CONT1) along with the data signal (DAS) to the data driver 300.

The data driver 300 samples and holds the data signal (DAS) input according to the first driving control signal (CONT1), and transmits a plurality of data signals (data[1]-data[m]) to a plurality of data lines.

The scan driver 400 generates a plurality of scan signals (S[1]-S[n]) at a gate-on level according to the second driving control signal (CONT2) during the reset period 1 and the compensation period 2, and concurrently (e.g., simultaneously) transmits them to a plurality of scan lines. The timing controller 200 generates the second driving control signal (CONT2) for controlling a point of time when a plurality of scan signals are input to a plurality of scan lines according to the vertical synchronization signal (Vsync) and the horizontal synchronization signal (Hsync).

The scan driver 400 sequentially generates a plurality of scan signals at the gate-on level corresponding to the scan period 3 among a plurality of scan signals (S[1]-S[n]) during the scan period 3 according to the second driving control signal (CONT2), and transmits them to the corresponding scan line among a plurality of scan lines. The scan driver 400 generates a plurality of scan signals (S[1]-S[n]) at the gate-off level during the light emitting period 4.

The power source controller 500 generates and supplies a power source voltage VDD and a power source voltage VSS in the reset period 1, the compensation period 2, the scan period 3, and the light emitting period 4 to a first group of pixels and a second group of pixels according to the third driving control signal (CONT3).

The power source voltage VDD is divided and supplied to the first group of pixels and the second group of pixels, and a phase difference corresponding to the half frame exists between the waveform of the power source voltage VDD supplied to the first group of pixels and the waveform of the power source voltage VDD supplied to the second group of pixels. Also, the power source voltage (VSS) is divided and supplied to the first group of pixels and the second group of pixels, and a phase difference corresponding to the half frame may exist between the waveform of the power source voltage (VSS) supplied to the first group of pixels and the waveform of the power source voltage (VSS) supplied to the second group of pixels.

The compensation control signal unit 600 determines a level of the first compensation control signal (GCE) during the compensation period 2 of the first group of pixels according to the fourth driving control signal (CONT4) and supplies it to the first group of pixels, and determines the level of the second compensation control signal (GOO) during the compensation period 2 of the second group of pixels and supplies it to the second group of pixels.

The timing controller 200 generates a first spectacles driving signal GDS1 to control opening/closing of a left eye lens 800_L and a right eye lens 800_R of first shutter spectacles 800, and a second spectacles driving signal GDS2 to control an operation of a left eye lens 900_L and a right eye lens 900R of second shutter spectacles 900.

The left eye lens 800_L of the first shutter spectacles 800 is opened by the first spectacles driving signal GDS1 during a period in which the left-eye image of the image A is displayed, and the right eye lens 800_R is closed. The left eye lens 800_L of the first shutter spectacles 800 is closed by the first spectacles driving signal GDS1 during a period in which the right-eye image of the image A is displayed, and the right eye lens 800R is opened.

The left eye lens 900_L of the second shutter spectacles 900 is opened by the second spectacles driving signal GDS2 during a period in which the left-eye image of the image B is displayed, and the right eye lens 900_R is closed. The right eye lens 900R of the second shutter spectacles 900 is opened by the second spectacles driving signal GDS2 during a period in which the right-eye image of the image B is displayed, and the left eye lens 900_L is closed.

The display unit 700 as the display area including the first group of pixels and the second group of pixels, includes a plurality of data lines for transmitting a plurality of data signals (data[1]-data[n]), a plurality of scan lines for transmitting a plurality of scan signals (S[1]-S[n]), power source wires for transmitting the power source voltage VDD, power source wires for transmitting the power source voltage (VSS), and a plurality of pixels having a control signal line and formed in a crossing region of the plurality of data lines and the plurality of scan lines.

Figure 9:
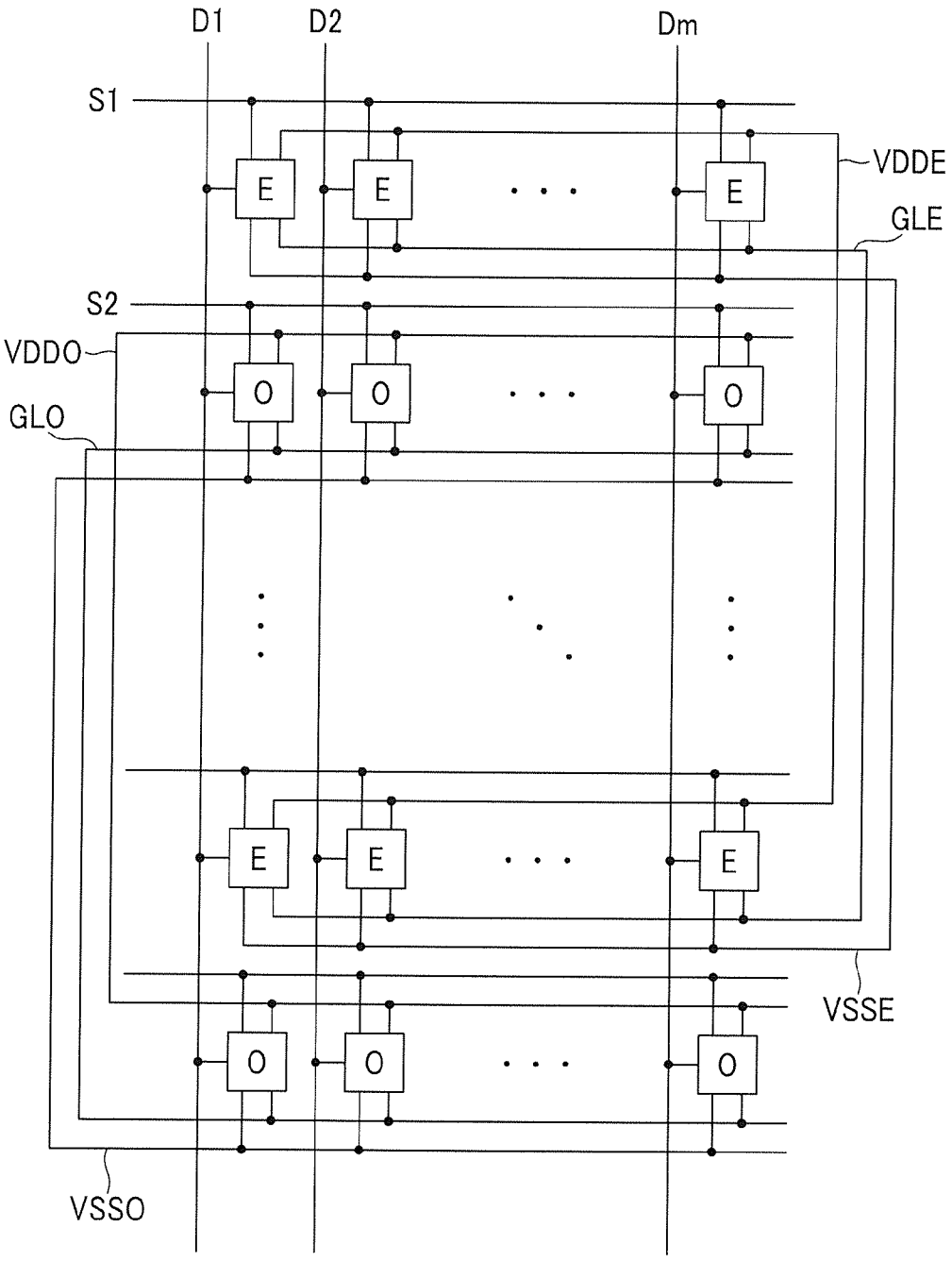
FIG. 9 is a view of a portion (hereinafter, a display unit) including an entire pixel in a display panel according to an exemplary embodiment of the present invention.

FIG. 9 is a view of a portion (hereinafter, a display unit) of all pixels in a display panel according to an exemplary embodiment of the present invention.

In the display panel shown in FIG. 9, the first group of pixels and the second group of pixels are arranged in a line-by-line pattern. However, the present invention is not limited thereto. In FIG. 9, a plurality of pixels of the first group of pixels are respectively indicated by 'E', and a plurality of pixels of the second group of pixels are respectively indicated by 'O'.

In FIG. 9, a plurality of scan lines S1-Sn for transmitting a plurality of scan signals (S[1]-S[n]), a plurality of data lines D1-Dm for transmitting a plurality of data signals (data[1]-data[m]), the first power source wire (VDDE) for supplying the power source voltage VDD to the first group of pixels (E), the second power source wire (VDDO) for supplying the power source voltage VDD to the second group of pixels (O), the first control signal line (GLE) for transmitting the first compensation control signal (GCE) to the first group of pixels (E), and the second control signal line (GLO) for transmitting the compensation control signal (GCO) to the second group of pixels (O), are provided.

Furthermore, the third power source wire (VSSE) for supplying the power source voltage (VSS) to the first group of pixels (E) and the fourth power source wire (VSSO) for supplying the power source voltage (VSS) to the second group of pixels (O) are provided.

A plurality of pixels (E) and a plurality of pixels (O) are respectively positioned at corresponding regions among a plurality of crossing regions where the plurality of scan lines (S1-Sm) and the plurality of data lines D1-Dm are crossed. An arrangement pattern of a plurality of rows including a plurality of pixels (E) and a plurality of rows including a plurality of pixels (O), is a line-by-line pattern and is alternately arranged according to the vertical direction in FIG. 9. Among the plurality of scan lines S1-Sn, the odd-numbered scan lines are connected to a plurality of pixels (E), and the even-numbered scan lines are connected to a plurality of pixels (O).

According to the pattern of the first group of pixels and the second group of pixels of the display device 100 shown in FIG. 9, the scan driver 400 sequentially generates the odd-numbered scan signals among the plurality of scan signals (S[1]-S[n]) at the gate-on level during the scan period 3 of the first group of pixels according to the second driving control signal (CONT2), and sequentially transmits them to the odd-numbered scan lines among the plurality of scan lines.

Also the scan driver 400 may sequentially generate the even-numbered scan signals among the plurality of scan signals (S[1]-S[n]) at the gate-on level during the scan period 3 of the second group of pixels according to the second driving control signal (CONT2), and may sequentially transmit them to the even-numbered scan lines among the plurality of scan lines.

However, the present invention is not limited thereto, and the pattern of the first group of pixels and the second group of pixels is not limited to the pattern shown in FIG. 9, and various patterns may be applied.

For example, a 1×1 pattern, a 2×1 pattern, or a 1×2 pattern may be applied to the first group of pixels and the second group of pixels. In this case, all scan lines are activated during each scan period 3 such that the scan driver 400 sequentially generates a plurality of scan signals (S[1]-S[n]) at the gate-on level, and sequentially transmits them to a plurality of scan lines.

Figure 10:
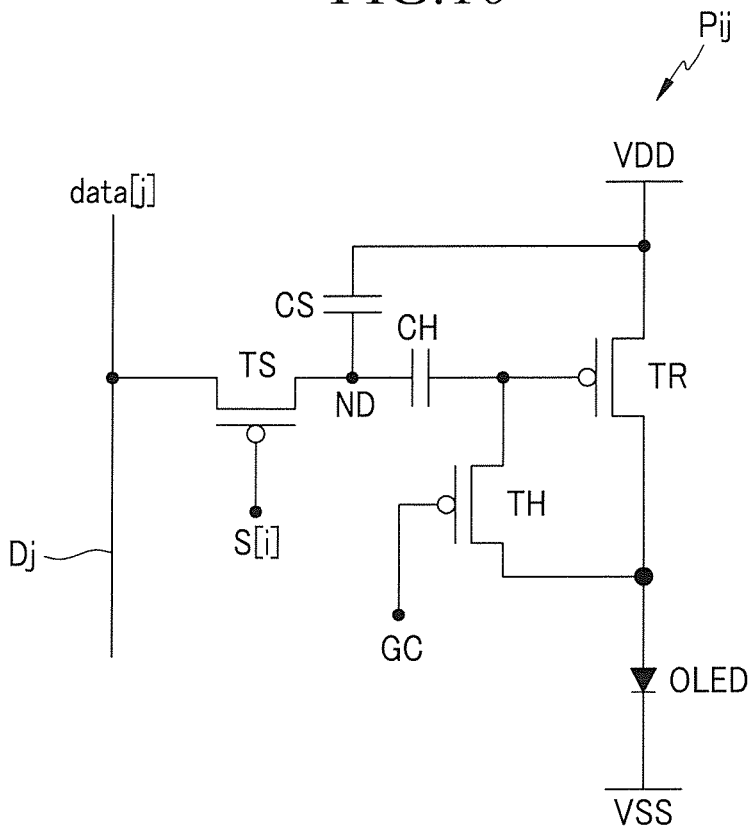
FIG. 10 is a view of a first group pixel.

FIG. 10 is a view showing a pixel of the first group. FIG. 8 shows the pixel (Eij) connected to the scan line (Si) and the data line (Dj).

As shown in FIG. 10, the pixel (Pij) includes a switching transistor (TS), a driving transistor (TR), a compensation transistor (TH), a compensation capacitor (CH), and a storage capacitor (CS).

The driving transistor (TR) includes a drain electrode connected to an anode of the organic light emitting diode (OLED), a gate electrode connected to one electrode of the compensation capacitor (CH), and a source electrode connected to the power source voltage (VDD). The driving transistor (TR) controls a driving current supplied to the organic light emitting diode (OLED_E).

The compensation transistor (TH) includes the gate electrode input with the first compensation control signal (GC), and two electrodes respectively connected to the drain electrode and the gate electrode of the driving transistor (TR).

The other electrode of the compensation capacitor (CH) is connected to one electrode of the storage capacitor (CS) and one electrode of the switching transistor (TS). The other electrode of the storage capacitor (CS) is connected to the power source voltage VDD.

The gate electrode of the switching transistor (TS) is input with the scan signal (S[i]), and the other electrode of the switching transistor (TS) is connected to the data line (Dj). The data signal (data[j]) is transmitted through the data line (Dj).

The cathode of the organic light emitting diode (OLED_E) is connected to the power source voltage (VSS).

The power source voltage VDD and the power source voltage VSS supply the driving voltage for the operation of the pixel. In more detail, the power source voltage VDD and the power source voltage VSS supply the driving voltage required for the operation according to the reset period 1, the compensation period 2, the scan period 3, and the light emitting period 4 of the driving transistor (TR) and the organic light emitting diode (OLED).

A pixel of the second group has the same structure as the pixel shown in FIG. 10. However, the pixel of the second group is connected to the third power source wire (VDDO) instead of the first power source wire (VDDE), to the fourth power source wire (VSSO) instead of the second power source wire (VSSE), and to a compensation control line (GLO) instead of the compensation control line (GLE).

During the reset period 1, the power source voltage (VSS) is a high level and the power source voltage (VDD) is a low level, and during the reset period 1, the anode voltage of the organic light emitting diode (OLED) is connected to the power source voltage VDD of the low level, thereby discharging the charges accumulated at the organic light emitting diode (OLED).

During the compensation period 2, the first compensation control signal (GCE) is at the low level and the compensation transistor (TH) is turned-on, and thereby the driving transistor (TR) is diode-connected. Accordingly, the gate electrode of the driving transistor (TR) is supplied with a voltage of which a threshold voltage of the driving transistor (TR) is subtracted from the power source voltage VDD. At this time, the compensation capacitor (CH) is charged with the charge corresponding to the voltage (VDD-VTH) of which the threshold voltage (VTH) of the driving transistor (TR) is subtracted from the power source voltage VDD.

During the scan period 3, a plurality of scan signals (S[1]-S[n]) are sequentially applied at the low level such that the switching transistor (TS) is turned-on. During the period that the switching transistor (TS) is turned-on, the data signal (data[j]) is transmitted to a node (ND) where the other electrode of the compensation capacitor (CH) and one electrode of the storage capacitor (CS) meet.

If the light emitting period 4 is started, the power source voltage VDD is increased to the high level, and the voltage of the node (ND) and the gate voltage of the driving transistor (TR) are increased according to a coupling operation of the capacitor (CS and CH). The driving current according to the increased voltage flows to the organic light emitting diode (OLED) from the driving transistor (TR).

An exemplary embodiment described with reference to FIGS. 9 and 10 is an example of the display device including the memories 10 and 30 according to an exemplary embodiment of the present invention. The present invention is not limited thereto.

Differently from the first driving method, the second driving method applied to the display unit in which all pixels of the display panel are not divided into the first group of pixels and the second group of pixels will now be described.

For example, when the display panel is arranged with a resolution of 1920×1080 pixels, the first left-eye image data of the half frame unit (980×1080), the first right-eye image data of the half frame unit, the second left-eye image data of the half frame unit, and the second right-eye image data of the half frame unit, are input from the memory 10 and are sequentially written to a plurality of pixels, and the plurality of corresponding pixels emit light according to the written image data.

Thus, the left-eye image of the image A, the right-eye image, the left-eye image of the image B, and the right-eye image may be sequentially displayed. As described above, the number of image data is fewer than a number of pixels of the display unit such that two adjacent pixels may be written with the same image data.

The first left-eye image data of one frame unit with a resolution of 1920×1080, the first right-eye image data of one frame unit, the second left-eye image data of one frame unit, and the second right-eye image data of one frame unit input from the memory 30 are respectively written to all pixels, and all pixels emit light according to the written image data.

Thus, the left-eye image of the image A, the right-eye image of the image A, the left-eye image of the image B, and the right-eye image of the image B may be sequentially displayed. At this time, the resolution is two times compared with the memory.

Figure 11:
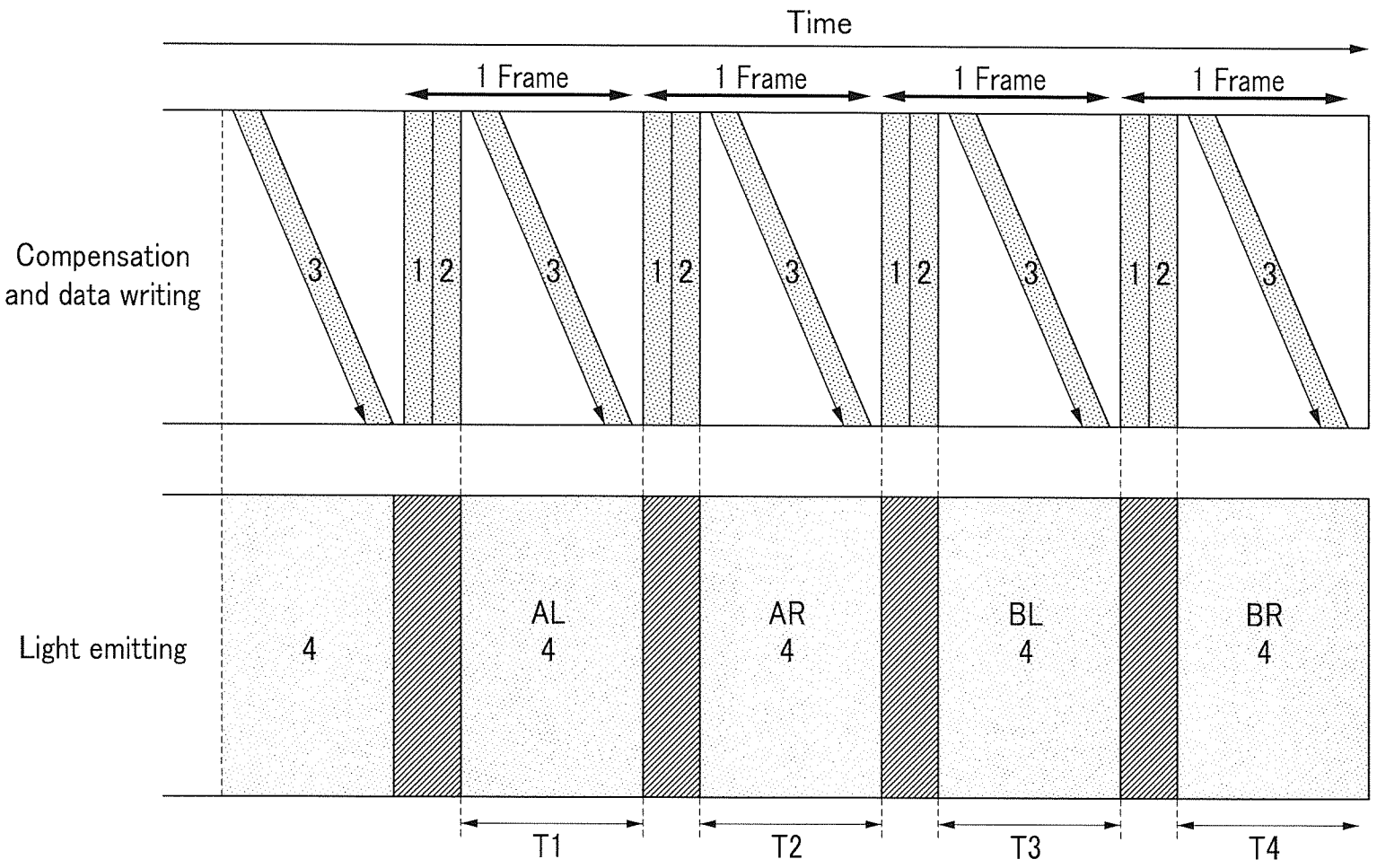
FIG. 11 is a view of a second driving method according to an embodiment of the present invention.

FIG. 11 is a view of the second driving method applied to the present invention according to an embodiment of the present invention.

As shown in FIG. 11, one frame includes the reset period 1, the compensation period 2, the scan period 3, and the light emitting period 4 like the previous exemplary embodiment. However, there is no division of the first field and the second field, and the scan period 3 and the light emitting period 4 are generated to be temporally overlapped in all pixels.

During the light emitting period 4 of the current frame, the pixel emits light according to the data written during the scan period 3 of the previous frame, and the pixel emits light during the light emitting period 4 of the next frame according to the data written during the scan period 3 of the current frame.

The first left-eye image data of the half frame unit stored in the memory 10 is written to all pixels during the scan period 3 of the previous frame of the period T1. As described above, when the resolution of the display unit is 1920×1080, two adjacent pixels are written with the same image data.

In FIG. 11, during the period T1, the left-eye image of the image A is displayed by the first written left-eye image data of the half frame unit, and the first right-eye image data of the half frame unit stored in the memory 10 is written to all pixels during the scan period 3.

During the period T2, the right-eye image of the image A is displayed by the written first right-eye image data of the half frame unit, and the second left-eye image data of the half frame unit stored in the memory 10 is written to all pixels during the scan period 3.

During the period T3, the left-eye image of the image B is displayed by the written second left-eye image data of the half frame unit, and the second right-eye image data of the half frame unit stored in the memory 10 is written to all pixels during the scan period 3.

During the period T4, the right-eye image of the image B is displayed by the written second right-eye image data of the half frame unit, and the first left-eye image data of the half frame unit stored in the memory 10 is written to all pixels during the scan period 3.

Also, in another embodiment, the first left-eye image data of one frame unit stored in the memory 30 is written to all pixels during the scan period of the previous frame of the period T1. The image data stored in the memory 30 is one frame unit such that it has the same as the resolution of 1920×1080 of the display unit.

In FIG. 11, during the period T1, the left-eye image of the image A is displayed by the written first left-eye image data of one frame unit, and the first right-eye image data of one frame unit stored in the memory 10 is written to all pixels during the scan period 3.

During the period T2, the right-eye image of the image A is displayed by the written first right-eye image data of one frame unit, and the second left-eye image data of one frame unit stored in the memory 10 is written to all pixels during the scan period 3.

During the period T3, the left-eye image of the image B is displayed by the written second left-eye image data of one frame unit, and the second right-eye image data of one frame unit stored in the memory 10 is written to all pixels during the scan period 3.

During the period T4, the right-eye image of the image B is displayed by the written second right-eye image data of one frame unit, and the first left-eye image data of one frame unit stored in the memory 10 is written to all pixels during the scan period 3.

Figure 12:
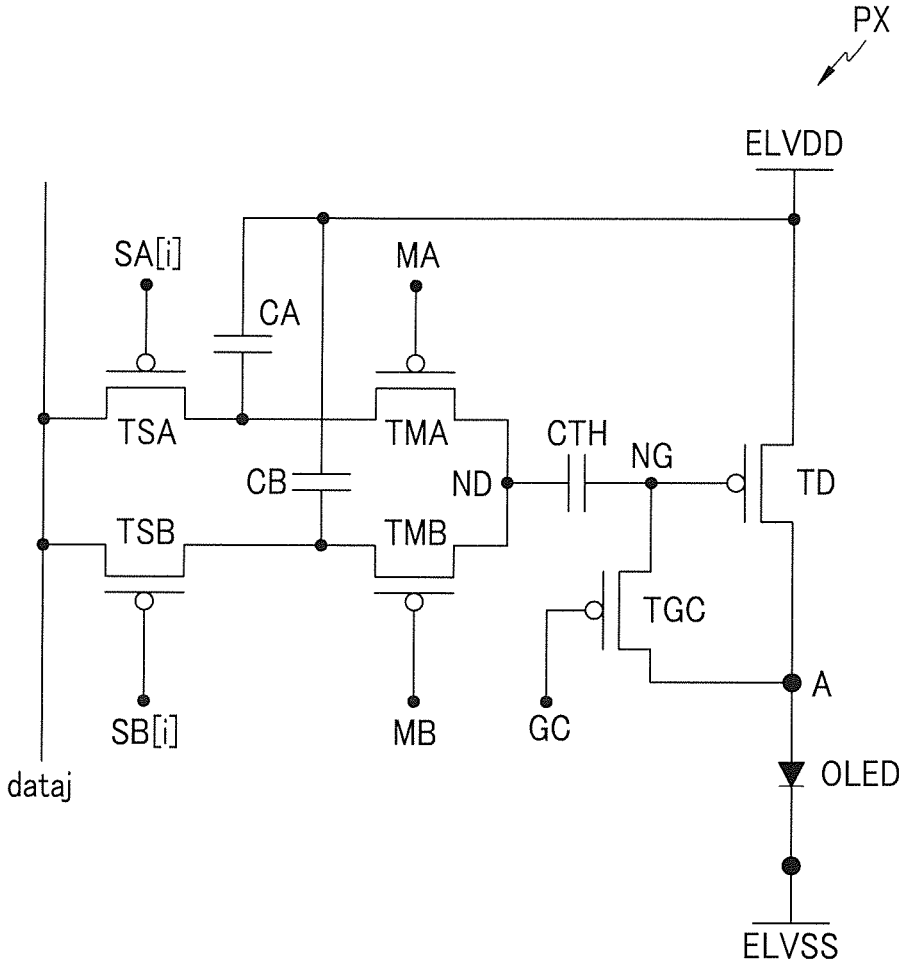
FIG. 12 is a view of a pixel structure for other driving methods according to an exemplary embodiment of the present invention.

Next, referring to FIG. 12, a pixel structure for the second driving method is described.

FIG. 12 is a view of a pixel structure for other driving methods according to an exemplary embodiment of the present invention. As shown in FIG. 12, the pixel includes six transistors (TD, TSA, TSB, TMA, TMB, TGC), two storage capacitors (CA, CB), a compensation capacitor (CTH), and an organic light emitting diode (OLED).

The driving voltage (ELVDD) and the driving voltage (ELVSS) for the operation of the pixel are respectively supplied to the terminals to which the driving transistor (TD) and the organic light emitting diode (OLED) are connected in series.

The driving transistor (TD) includes the source electrode connected to the driving voltage (ELVDD), the drain electrode connected to the anode of the organic light emitting diode (OLED), and the gate electrode connected to the compensation capacitor (CTH).

The compensation transistor (TGC) includes both electrodes respectively connected to the gate electrode and the drain electrode of the driving transistor (TD), and the gate electrode of the compensation transistor (TGC) is input with the compensation control signal (GC). The compensation transistor (TGC) diode-connects the driving transistor (TD) during the compensation period 2.

The compensation capacitor (CTH) includes one electrode connected to the gate electrode of the driving transistor (TD), and the other electrode connected to each one electrode of two transistors (TMA, TMB).

The first operation control transistor (TMA) includes the gate electrode input with the first operation control signal (MA), one electrode connected to the other electrode of the compensation capacitor (CTH), and the other electrode connected to one electrode of the first switching transistor (TSA) and one electrode of the storage capacitor (CA).

The first switching transistor (TSA) includes the gate electrode input with the scan signal (SA[i]), one electrode connected to the other electrode of the first operation control transistor (TMA) and one electrode of the capacitor (CA), and the other electrode connected to the data line (dataj). The first switching transistor (TSA) transmits the data signal to the capacitor (CA).

The second operation control transistor (TMB) includes the gate electrode input with the second operation control signal (MB), one electrode connected to the other electrode of the compensation capacitor (CTH), and the other electrode connected to one electrode of the second switching transistor (TSB) and one electrode of the storage capacitor (CB).

The second switching transistor (TSB) includes the gate electrode input with the scan signal (SB[i]), one electrode connected to the other electrode of the second operation control transistor (TMB) and one electrode of the storage capacitor (CB), and the other electrode connected to the data line (dataj). The second switching transistor (TSB) transmits the data signal to the capacitor (CB).

The other electrode of the storage capacitor (CA) is connected to the voltage (ELVDD), and the other electrode of the storage capacitor (CB) is connected to the voltage (ELVDD).

The pixel shown in FIG. 12 includes the first path driving the driving transistor (TD) according to the data signal written to the storage capacitor (CA) and the second path driving the driving transistor (TD) according to the data signal written to the storage capacitor (CB).

The switch controlling the opening and the connection of the first path is the transistor (TMA), and the switch controlling the opening and the connection of the second path is the transistor (TMB). The transistor (TMA) is controlled by the first operation control signal (MA), and the transistor (TMB) is controlled by the second operation control signal (MB).

The pixel structure shown in FIG. 12 is only one example to realize the driving method of FIG. 11. The present invention is not limited thereto.

The memory and the addressing method, and the display device according to exemplary embodiments of the present invention have been described. Through the exemplary embodiments, the write frequency and the read frequency of the DDR3 memory may provide the same effect.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims and their equivalents.

DESCRIPTION OF SOME SYMBOLS

Memory 10 and 30, line buffer unit 20 and 40, first to fourth line buffer 21-24, fifth to eighth line buffer 41-44, rearrangement unit 11 and 31, block (BC0-BC3), first to sixth DDR3 memory (12, 13, 32, 33, 34, 35), display device 100, timing controller 200, data driver 300, scan driver 400, power source controller 500, compensation control signal unit 600, display unit 700, scan line S1-Sn, data line D1-Dm, first group pixel (E), first power source wire (VDDE), second group pixel (O), second power source wire (VDDO), control signal line (GLE, GLO), switching transistor (TS), driving transistor (TR), compensation transistor (TH), compensation capacitor (CH, CTH), storage capacitor (CS, CA, CB), organic light emitting diode (OLED).

What is claimed is:

1. A memory for storing first image data and second image data of a line unit stored in a line buffer unit, comprising:

at least a first DDR3 memory and a second DDR3 memory; and a rearrangement unit configured to:

read the first image data of the line unit, divide the read first image data of the line unit, and write the divided first image data to a corresponding block among a plurality of blocks of each of the first DDR3 memory and the second DDR3memory; and read the second image data of the line unit, divide the read second image data of the line unit, and write the divided second image data to another corresponding block among the plurality of blocks of each of the first DDR3 memory and the second DDR3 memory, wherein a first image is displayed according to the first image data, and a second image is displayed according to the second image data, wherein the first image data of the line unit comprises first view point image data of the first image and second view point image data of the first image, and wherein the second image data of the line unit comprises first view point image data of the second image and second view point image data of the second image, and wherein each of the first DDR3 memory and the second DDR3 memory comprises a first block, a second block, a third block, and a fourth block, and the rearrangement unit is configured to:

divide the first view point image data included in the first image data of the line unit and write the divided first view point image data to the first block of the first DDR3 memory and the first block of the second DDR3 memory;

divide the second view point image data included in the first image data of the line unit and write the divided second view point image data to the second block of the first DDR3 memory and the second block of the second DDR3 memory;

divide the first view point image data included in the second image data of the line unit and write the divided first view point image data to the third block of the first DDR3 memory and the third block of the second DDR3 memory; and divide the second view point image data included in the second image data of the line unit and write the divided second view point image data to the fourth block of the first DDR3 memory and the fourth block of the second DDR3 memory.

2. The memory of claim 1, wherein the first image data of the line unit of an n-th frame of the first image data comprises the first view point image data of the first image, and the second image data of the line unit of the n-th frame of the second image data comprises the first view point image data of the second image.

3. The memory of claim 2, wherein the first image data of the line unit of an (n+1)-th frame of the first image data comprises the second view point image data of the first image, and the second image data of the line unit of the (n+1)-th frame of the second image data comprises the second view point image data of the second image.

4. The memory of claim 3, further comprising a third DDR3 memory and a fourth DDR3 memory, each of the first to fourth DDR3 memories comprises the first to fourth blocks, and wherein the rearrangement unit is configured to divide the first image data of the line unit of the n-th frame of the first image data and write the divided first image data to the first block of the first DDR3 memory, the first block of the second DDR3 memory, the first block of the third DDR3 memory, and the first block of the fourth DDR3 memory.

5. The memory of claim 4, wherein the rearrangement unit is configured to divide the second image data of the line unit of the n-th frame of the second image data and write the divided second image data to the third block of the first DDR3 memory, the third block of the second DDR3memory, the third block of the third DDR3 memory, and the third block of the fourth DDR3 memory.

6. The memory of claim 5, wherein the rearrangement unit is configured to divide the first image data of the line unit of the (n+1)-th frame of the first image data and write the divided first image data to the second block of the first DDR3 memory, the second block of the second DDR3 memory, the second block of the third DDR3 memory, and the second block of the fourth DDR3 memory.

7. The memory of claim 6, wherein the rearrangement unit is configured to divide the second image data of the line unit of the (n+1)-th frame of the second image data and write the divided second image data to the fourth block of the first DDR3 memory, the fourth block of the second DDR3 memory, the fourth block of the third DDR3 memory, and the fourth block of the fourth DDR3 memory.

8. The memory of claim 1, wherein the rearrangement unit is configured to divide the read first image data of the line unit and the read second image data of the line unit according to a quantity of the DDR3 memories.

9. A method of addressing first image data and second image data of a line unit stored in a line buffer unit to at least two memories comprising a first DDR3 memory and a second DDR3 memory, comprising:

a) reading the first image data of the line unit and dividing the read first image data of the line unit, and writing the divided first image data to a first address of a corresponding block among a plurality of blocks of each of the first DDR3 memory and the second DDR3 memory;

b) reading the second image data of the line unit and dividing the read second image data of the line unit, and writing the divided second image data to the first address of another corresponding block among the plurality of blocks of each the first DDR3 memory and the second DDR3 memory;

c) reading the first image data of a next line unit of the first image data of the line unit and dividing the read first image data of the next line unit, and writing the divided first image data to a second address of a corresponding block of each of the first DDR3 memory and the second DDR3 memory; and d) reading the second image data of a next line unit of the second image data of the line unit and dividing the read second image data of the next line unit, and writing the divided second image data to the second address of another corresponding block of each of the first DDR3 memory and the second DDR3 memory, wherein a first image is displayed according to the first image data, and a second image is displayed according to the second image data, wherein the first image data of the line unit comprises first view point image data of the first image and second view point image data of the first image, and wherein the second image data of the line unit comprises first view point image data of the second image and second view point image data of the second image.

10. The method of claim 9 wherein each of the first DDR3 memory and the second DDR3 memory comprises a first block, a second block, a third block, and a fourth block, and the method further comprises:

dividing the first view point image data included in the first image data of the line unit and writing the divided first view point image data to the first address of the first block of the first DDR3 memory and the first address of the first block of the second DDR3 memory; and dividing the second view point image data included in the first image data of the line unit and writing the divided second view point image data to the first address of the second block of the first DDR3 memory and the first address of the second block of the second DDR3 memory.

11. The method of claim 10, further comprising:

dividing the first view point image data included in the second image data of the line unit and writing the divided first view point image data to the first address of the third block of the first DDR3 memory and the first address of the third block of the second DDR3 memory; and dividing the second view point image data included in the second image data of the line unit and writing the divided second view point image data to the first address of the fourth block of the second DDR3 memory and the first address of the fourth block of the second DDR3 memory.

12. The method of claim 11, further comprising:

dividing the first view point image data included in the first image data of a next line unit and writing the divided first view point image data to the second address of the first block of the first DDR3 memory and the second address of the first block of the second DDR3 memory; and dividing the second view point image data included in the first image data of the next line unit and writing the divided second view point image data to the second address of the second block of the first DDR3 memory and the second address of the second block of the second DDR3 memory.

13. The method of claim 12, further comprising:

dividing the first view point image data included in the second image data of a next line unit and writing the divided first view point image data to the second address of the third block of the first DDR3 memory and the second address of the third block of the second DDR3 memory; and dividing the second view point image data included in the second image data of the next line unit and writing the divided second view point image data to the second address of the fourth block of the first DDR3 memory and the second address of the fourth block of the second DDR3 memory.

14. The method of claim 9, wherein the first image data of the line unit of the n-th frame of the first image data comprises the first view point image data of the first image, and the second image data of the line unit of the n-th frame of the second image data comprises the first view point image data of the second image.

15. The method of claim 14, wherein the at least two memories further comprise a third DDR3 memory and a fourth DDR3 memory, each of the first to the fourth DDR3 memories comprises a first block, a second block, a third block, and a fourth block, and the method further comprises dividing the first image data of the line unit of the n-th frame of the first image data and writing the divided first image data to the first address of the first block of the first DDR3 memory, the first address of the first block of the second DDR3 memory, the first address of the first block of the third DDR3 memory, and the first address of the first block of the fourth DDR3 memory.

16. The method of claim 15, further comprises dividing the second image data of the line unit of the n-th frame of the second image data and writing the divided second image data to the first address of the third block of the first DDR3 memory, the first address of the third block of the second DDR3 memory, the first address of the third block of the third DDR3 memory, and the first address of the third block of the fourth DDR3 memory.

17. The method of claim 14, wherein the first image data of the line unit of the (n+1)-th frame of the first image data comprises the second view point image data of the first image, and the second image data of the line unit of the (n+1)-th frame of the second image data comprises the second view point image data of the second image.

18. The method of claim 17, wherein:

the at least two memories further comprise a third DDR3 memory and a fourth DDR3 memory, each of the first to fourth DDR3 memories comprises a first block, a second block, a third block, and a fourth block; and the method further comprising c) dividing the first image data of the line unit of the (n+1)-th frame of the first image data and writing the divided first image data to the first address of the second block of the first DDR3 memory, the first address of the second block of the second DDR3 memory, the first address of the second block of the third DDR3 memory, and the first address of the second block of the fourth DDR3 memory.

19. The method of claim 18, further comprising d) dividing the second image data of the line unit of the n-th frame of the second image data and writing the divided second image data to the first address of the fourth block of the first DDR3 memory, the first address of the fourth block of the second DDR3 memory, the first address of the fourth block of the third DDR3 memory, and the first address of the fourth block of the fourth DDR3 memory.

20. A display device for displaying a first image and a second image according to first image data and second image data, comprising:

a line buffer unit for respectively storing the first image data and the second image data as a line unit;

a memory comprising at least a first DDR3 memory and a second DDR3 memory, configured to read the first image data of the line unit, divide the read first image data of the line unit, and write the divided first image data to a corresponding block among a plurality of blocks of each of the first DDR3 memory and the second DDR3 memory, and read the second image data of the line unit, divide the read second image data of the line unit, and write the divided second image data to another corresponding block among the plurality of blocks of each of the first DDR3 memory and the second DDR3 memory; and a display unit comprising a plurality of pixels for emitting light according to the image data stored in the memory, wherein the first image data of the line unit comprises first view point image data of the first image and second view point image data of the first image, and the second image data of the line unit comprises first view point image data of the second image and second view point image data of the second image, wherein each of the first DDR3 memory and the second DDR3 memory comprises a first block, a second block, a third block, and a fourth block, and wherein the memory is configured to:

divide the first view point image data included in the first image data of the line unit, and write the divided first view point image data to the first block of the first DDR3 memory and the first block of the second DDR3 memory;

divide the second view point image data included in the first image data of the line unit, and write the divided second view point image data to the second block of the first DDR3 memory and the second block of the second DDR3 memory;

divide the first view point image data included in the second image data of the line unit, and write the divided first view point image data to the third block of the first DDR3 memory and the third block of the second DDR3 memory; and divide the second view point image data included in the second image data of the line unit, and write the divided second view point image data to the fourth block of the first DDR3 memory and the fourth block of the second DDR3 memory.

21. The display device of claim 20, further comprising a plurality of pixels configured to sequentially emit light according to the data written to the first block of the first DDR3 memory and the first block of the second DDR3 memory, the second block of the first DDR3 memory and the second block of the second DDR3 memory, the third block of the first DDR3 memory and the third block of the second DDR3 memory, and the fourth block of the first DDR3 memory and the fourth block of the second DDR3 memory.

22. The display device the of claim 21, wherein the plurality of pixels comprise a first group of pixels and a second group of pixels, wherein:

the first group of pixels are configured to sequentially emit light according to half of the data written to the first block of the first DDR3 memory and the first block of the second DDR3 memory, the second block of the first DDR3 memory and the second block of the second DDR3 memory, the third block of the first DDR3 memory and the third block of the second DDR3 memory, and the fourth block of the first DDR3 memory and the fourth block of the second DDR3 memory; and the second group of pixels are configured to sequentially emit light according to the remaining half of the data written to the first block of the first DDR3 memory and the first block of the second DDR3 memory, the second block of the first DDR3 memory and the second block of the second DDR3 memory, the third block of the first DDR3 memory and the third block of the second DDR3 memory, and the fourth block of the first DDR3 memory and the fourth block of the second DDR3 memory.

23. The display device the of claim 20, wherein the first image data of the line unit of the n-th frame of the first image data comprises the first view point image data of the first image, the second image data of the line unit of the n-th frame of the second image data comprises the first view point image data of the second image, the first image data of the line unit of the (n+1)-th frame of the first image data comprises the second view point image data of the first image, and the second image data of the line unit of the (n+1)-th frame of the second image data comprises the second view point image data of the second image.

24. The display device of claim 23, wherein the memory further comprises a third DDR3 memory and a fourth DDR3 memory, each of the first to fourth DDR3 memories comprises the first to fourth blocks, and the memory is configured to:

divide the first image data of the line unit of the n-th frame of the first image data and write the divided first image data to the first block of the first DDR3 memory, the first block of the second DDR3 memory, the first block of the third DDR3 memory, and the first block of the fourth DDR3 memory;

divide the second image data of the line unit of the n-th frame of the second image data and write the divided second image data to the third block of the first DDR3 memory, the third block of the second DDR3 memory, the third block of the third DDR3 memory, and the third block of the fourth DDR3 memory;

divide the first image data of the line unit of the (n+1)-th frame of the first image data and write the divided first image data to the second block of the first DDR3 memory, the second block of the second DDR3 memory, the second block of the third DDR3 memory, and the second block of the fourth DDR3 memory; and divide the second image data of the line unit of the (n+1)-th frame of the second image data and write the divided second image data to the fourth block of the first DDR3 memory, the fourth block of the second DDR3 memory, the fourth block of the third DDR3 memory, and the fourth block of the fourth DDR3 memory.

25. The display device of claim 24, further comprising a plurality of pixels configured to sequentially emit light according to the data written to the first block of each of the first to fourth DDR3 memories, the second block of each of the first to fourth DDR3 memories, the third block of each of the first to fourth DDR3 memories, and the fourth block of each of the first to fourth DDR3 memories.

26. The display device the of claim 25, wherein the plurality of pixels comprises a first group of pixels and a second group of pixels, wherein:

the first group of pixels are configured to sequentially emit light according to half of the data written to the first block of each of the first to fourth DDR3 memories, the second block of each of the first to fourth DDR3 memories, the third block of each of the first to fourth DDR3 memories, and the fourth block of each of the first to fourth DDR3 memories; and the second group pixels are configured to sequentially emit light according to the remaining half of the data written to the first block of each of the first to fourth DDR3 memories, the second block of each of the first to fourth DDR3 memories, the third block of each of the first to fourth DDR3 memories, and the fourth block of each of the first to fourth DDR3 memories.

27. The display device of claim 20, wherein:

the display unit further comprises a plurality of scan lines for transmitting a plurality of scan signals, and a plurality of data lines for transmitting a plurality of data signals, to a first of pixels and a second group of pixels; and a light emitting period in which the first group of pixels emit light according to a plurality of written data signals, and a scan period in which a plurality of data signals are transmitted to the second group of pixels, overlap each other.

28. The display device of claim 27, wherein:

each pixel of the first group of pixels and the second group of pixels comprises a driving transistor to which a driving current according to the written data signal flows, and an organic light emitting diode (OLED) coupled to the driving transistor and being configured to emit light according to the driving current; and during a reset period for resetting an anode voltage of the organic light emitting diode (OLED), a first power source voltage applied to the driving transistor is lower than a second power source voltage applied to a cathode of the organic light emitting diode (OLED).

29. The display device of claim 28, wherein:

each of the first group of pixels and the second group of pixels further comprises a capacitor coupled to a gate electrode of the driving transistor and coupled to the first power source voltage; and during a compensation period in which the driving transistor is diode-connected, the capacitor is stored with a threshold voltage of the driving transistor.

30. The display device of claim 29, wherein a level of the first power source voltage during the light emitting period is higher than that of the first power source voltage of the reset period, the compensation period, and the scan period.

31. The display device of claim 20, wherein each of the plurality of pixels comprises:

an organic light emitting diode (OLED);

a driving transistor coupled to a driving voltage and being configured to supply a driving current to the organic light emitting diode (OLED);

a compensation capacitor coupled to the gate electrode of the driving transistor; and a first storage capacitor and a second storage capacitor configured to selectively electrically couple to or decouple from the compensation capacitor, wherein the data voltage is stored according to the data signal corresponding to the first storage capacitor in a first period, and the organic light emitting diode (OLED) emits light according to the driving current flowing to the driving transistor by the data voltage stored in the second storage capacitor in a second period.

* * * * *